US007607660B2

(12) United States Patent
Inoue

(10) Patent No.: US 7,607,660 B2
(45) Date of Patent: Oct. 27, 2009

(54) SHEET CONVEYING APPARATUS, IMAGE FORMING APPARATUS, AND IMAGE SCANNING APPARATUS

(75) Inventor: Hiroshige Inoue, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 11/766,467

(22) Filed: Jun. 21, 2007

(65) Prior Publication Data

US 2008/0006992 A1 Jan. 10, 2008

(30) Foreign Application Priority Data

Jun. 26, 2006 (JP) ..... 2006-175565

(51) Int. Cl.
*B65H 7/02* (2006.01)

(52) U.S. Cl. ..... 271/228; 271/227

(58) Field of Classification Search ..... 271/227, 271/228

See application file for complete search history.

(56) References Cited

U.S. PATENT DOCUMENTS

| | | | | |
|---|---|---|---|---|
| 6,374,075 | B1 * | 4/2002 | Benedict et al. | 399/395 |
| 6,634,521 | B1 * | 10/2003 | Hwang | 221/228 |
| 6,676,123 | B2 * | 1/2004 | Sahlmann | 271/227 |
| 6,834,853 | B2 * | 12/2004 | Trovinger et al. | 271/227 |
| 7,219,888 | B2 * | 5/2007 | Trovinger et al. | 271/227 |
| 7,422,210 | B2 * | 9/2008 | Dejong et al. | 271/228 |
| 2004/0239027 | A1 * | 12/2004 | Trovinger et al. | 271/227 |
| 2005/0087920 | A1 * | 4/2005 | Takamatsu | 271/10.01 |

FOREIGN PATENT DOCUMENTS

JP 04-277151 A 10/1992

* cited by examiner

*Primary Examiner*—Patrick H Mackey
*Assistant Examiner*—Michael C McCullough
(74) *Attorney, Agent, or Firm*—Canon U.S.A., Inc., IP Division

(57) ABSTRACT

A sheet conveying apparatus includes a skew correction unit configured to correct the skew of a sheet while conveying the sheet, controls the skew correction unit to correct the rough skew of the sheet by a first skew correction operation, and accurately correct the reduced skew of the sheet by a second skew correction operation.

6 Claims, 20 Drawing Sheets

SHEET CONVEYING APPARATUS, IMAGE FORMING APPARATUS, AND IMAGE SCANNING APPARATUS

BACKGROUND OF THE INVENTION

1. Field of the Invention

The present invention relates to a sheet conveying apparatus to be included in an image forming apparatus such as a copier, a printer, a facsimile, and so forth, and an image scanning apparatus such as a scanner, and so forth.

2. Description of the Related Art

In recent years, with image forming apparatuses, there has been demand for high productivity (the number of sheets on which an image can be formed per unit time), and demand for reduction in size thereof, and also there has been increased demand for correcting skewing or misalignment of sheets with high precision, to improve image quality. Further, regarding thickness of sheets to be employed, it is necessary to convey thin paper to thick paper, small sizes such as a postcard to large size of 330 mm×488 mm or so regarding sizes, and further various types of paper such as coated paper, embossed paper, and so forth regarding paper type, in addition to plain paper.

First, in order to realize high productivity, it is effective to reduce the interval of sheets to be conveyed (the distance between the trailing edge of the preceding sheet and the leading edge of the next sheet) as short as possible (short paper interval). Along with this, it is necessary to correct the skew and misalignment of sheets occurring at the time of supplying sheets over a short period of time.

Consequently, as for a skew correction unit configured to correct the skew of a sheet, a method arranged to correct the skew of a sheet while conveying the sheet has been proposed instead of an existing method arranged to correct the skew of a sheet by contacting the tip of a sheet against the pressing portion (nip portion) of a stopped roller pair. This technology has been disclosed in Japanese Patent Laid-Open No. 1992-277151. This skew correction method is a so-called active registration method, which has an arrangement such as shown in FIG. 17, for example.

As shown in FIG. 17, two sensors 1101*a* and 1101*b* are disposed in the direction (sheet width direction) orthogonal to the sheet conveying direction (a sheet proceeds from the left to the right in the drawing), and detect the tip of a sheet S to be conveyed. Subsequently, the amount of skew of the tip of a sheet S is calculated based on a detection signal when the sheet S passes through the sensors 1101*a* and 1101*b*. Subsequently, according to a skew correction roller pair 1103*a* and 1103*b* which are disposed on the same shaft in the sheet width direction with a predetermined interval, and are independently driven and controlled by motors 1102*a* and 1102*b* respectively, the skew of the sheet S is corrected depending on the amount of the calculated skew. Thus, the skew can be corrected even in the event that the interval between sheets is short.

As shown in FIG. 18A, when assuming that the conveying velocity at the time of correction by the skew correction roller pair 1103*a* and 1103*b* are $V_L$ and $V_R$, the thrust pitch between the skew correction roller pair is $L_{RP}$, and the rotation velocity at the rotation center o of the sheet S is ω, $$\omega = \frac{V_R - V_L}{L_{RP}} \quad [1]$$

holds.

As shown in FIG. 18B, when assuming that the rotation radius from the rotation center O of the sheet S to the center o' between the skew correction roller pair 1103*a* and 1103*b* is $R_{ROT}$, according to "$R_{ROT}\cdot\omega\equiv(V_L+V_R)/2$", $$R_{ROT} = \frac{V_L + V_R}{2|V_R - V_L|} \cdot L_{RP} \quad [2]$$

holds.

According to that the force applied at the time of correction by the skew correction roller pair 1103*a* and 1103*b* are $F_L$ and $F_R$, the conveying load (back tension) applied to the sheet S is $F_{BT}$, and the relation of force balance is "$F_L+F_R+F_{BT}\equiv 0$", $$F_{Lx}+F_{Rx}+F_{BTx}=0$$

$$F_{Ly}+F_{Ry}+F_{BTy}=0$$

hold.

According to that from the rotation center o of the sheet S to the skew correction roller pair 1103*a* and 1103*b* are $R_L$ and $R_R$, from the rotation center o of the sheet S to a conveying load point is $R_{BT}(X, Y)$, and the relation of moment balance is "$R_L\cdot F_L+R_R\cdot F_R+R_{BT}\cdot F_{BT}\equiv 0$", $$-(R_{ROT}-L_{RP}/2)F_{Lx}-(R_{ROT}+L_{RP}/2)F_{Rx}+(XF_{BTy}+YF_{BTx})=0$$

holds.

The conveying load $F_{BT}$ applied to the sheet S is ideally applied in the opposite direction of the rotation conveying direction of the sheet S, so according to "$R_{BT}\perp F_{BT}$", $$XF_{BTx}+YF_{BTy}=0$$

holds.

Accordingly, $$F_{Lx}=-1/2\cdot[1-2/L_{RP}\cdot\{(X^2+Y^2)/Y\cdot RROT\}\cdot F_{BTx} \quad \text{Expression (1)}$$

$$F_{Rx}=-1/2\cdot[1+2/L_{RP}\cdot\{(X^2+Y^2)/Y\cdot RROT\}\cdot F_{BTx} \quad \text{Expression (2)}$$

hold.

In general, it has been known that when assuming that the ideal maximum conveying force of the skew correction roller pair is $F_0$, and the conveying load applied to the sheet S is $F_{BT}$, the slip ratio of the rollers can be represented with a function of $F_{BT}/F_0$ experimentally. When assuming that ideal velocity is $V_0$, actual velocity V, and a slip ratio function is $F(F_{BT}/F_0)$, the conveying velocity at the time of skew correction is $$V=(1-F(F_{BT}/F_0))V_0$$

When assuming that control time is τ, and the amount of slip is $\Delta d$, $$\Delta d\approx(V_0-V)\tau=F(F_{BT}/F_0)V_0\tau$$

holds.

It has been known that when the roller slip $\Delta d$ is sufficiently small, the slip ratio function is experimentally capable of approximating a proportional expression, so when employing a constant k, $$\Delta d\approx k(F_{BT}/F_{max})V_0\tau$$

holds.

Skew correction accuracy becomes the difference $|\Delta d_{Lx}-\Delta d_{Rx}|$ of the amount of slip between the skew correction roller pair 1103*a* and 1103*b*, $$|\Delta d_{Lx}-\Delta d_{Rx}|\approx k(|F_{Lx}V_LF_{Rx}V_R|/F_{max})\tau \quad \text{Expression (3)}$$

holds.

Thus, the force $F_{Lx}$ and $F_{Rx}$ applied at the time of correction by the skew correction roller pair 1103*a* and 1103*b* is proportionate to the conveying load $F_{BT}$ as to the sheet. Accordingly, in general, a configuration has been employed wherein all of the upstream-side conveying rollers shown in FIG. 19 of the skew correction roller pair 1103*a* and 1103*b* are separated to turn a conveying guide into a straight path, thereby reducing the conveying load $F_{BT}$ as to the sheet.

However, turning the conveying guide of a registration portion into a straight path leads in a problem wherein the whole apparatus increases in size. Accordingly, in order to reduce the size of the apparatus, it is necessary to dispose a bent conveying guide upstream of the registration portion, but the bent conveying guide causes the conveying load $F_{BT}$ as to the sheet to increase drastically.

Additionally, in recent years, the grammage of sheets to be employed is diversified into various kinds from thin paper of 50 g/m$^2$ or so to thick paper of 300 g/m$^2$, and the size of sheets is also diversified into various kinds from a small size of a postcard or so to a great size of 330 mm×488 mm or so. In particular, when correcting the skew or misalignment of large-sized sheets employing thick paper having great inertial force, the conveying load $F_{BT}$ as to the sheet further increases. Thus, the force $F_{Lx}$ and $F_{Rx}$ applied at the time of correction by the skew correction roller pair 1103*a* and 1103*b* also increases pro rata. The force differences with the force $F_{Lx}$ and $F_{Rx}$ applied at the time of correction increase simultaneously (Expressions (1) and (2)), which leads in a problem wherein skew correction accuracy is deteriorated by slip of the skew correction roller pair (Expression (3)).

Further, as for the types of sheets to be conveyed as well, in addition to plain paper, various types of paper such as coated paper, embossed paper, and so forth have been requested. Therefore, with a sheet feeder configured to separate and feed the uppermost sheet of a loaded sheet bundle one at a time, so called "air sheet feeding" is frequently employed wherein air is sprayed on the loaded sheet bundle to compulsorily separate the sheet bundle one at a time. Thus, various types of loaded sheet bundle can be separated and fed one at a time, but there is a possibility that the sheets on which air was sprayed are greatly skewed. Therefore, in order to correct the great skewing of the sheets with a short conveying path length in a short period of time, it is necessary to increase the velocity difference as to the conveying velocity $V_L$ and $V_R$ at the time of correction by the skew correction roller pair 1103*a* and 1103*b* (equivalent to reduce the rotation radius $R_{ROT}$). In addition to the velocity difference as to the conveying velocity $V_L$ and $V_R$, the force difference as to the force $F_{Lx}$ and $F_{Rx}$ applied at the time of correction by the skew correction roller pair 1103*a* and 1103*b* also increases simultaneously (Expressions (1) and (2)), which leads in a problem wherein skew correction accuracy is deteriorated by slip of the skew correction roller pair (Expression (3)).

SUMMARY OF THE INVENTION

To this end, the present invention provides a sheet conveying apparatus capable of accurately correcting the skew and misalignment of various types of sheet with an inexpensive configuration even in the event of reducing the apparatus in size.

A sheet conveying apparatus according to an exemplary embodiment of the present invention may include a skew detection unit configured to detect a skew of a sheet; and a skew correction unit configured to correct the skew of a sheet by conveying and rotating the sheet based on a detection of the skew detection unit; wherein the skew correction unit performs a first skew correction operation and a second skew correction operation after the first skew correction operation such that an amount of skew correction by the second skew correction operation is smaller than an amount of skew correction by the first skew correction operation.

Also, according to another aspect of the present invention, a sheet conveying apparatus is provided which includes a skew detection unit configured to detect a skew of a sheet; and a skew correction unit configured to correct the skew of a sheet by conveying and rotating the sheet based on a detection of the skew detection unit; wherein the skew correction unit performs a first skew correction operation and a second skew correction operation after the first skew correction operation such that with the second skew correction operation, slips between the skew correction unit and the sheet is fewer as compared with the first skew correction operation.

Further features and aspects of the present invention will become apparent from the following description of exemplary embodiments with reference to the attached drawings.

DESCRIPTION OF THE EMBODIMENTS

Exemplary embodiments, features and aspects of the present invention will be described below in detail with reference to the drawings.

First Exemplary Embodiment

Figure 1:
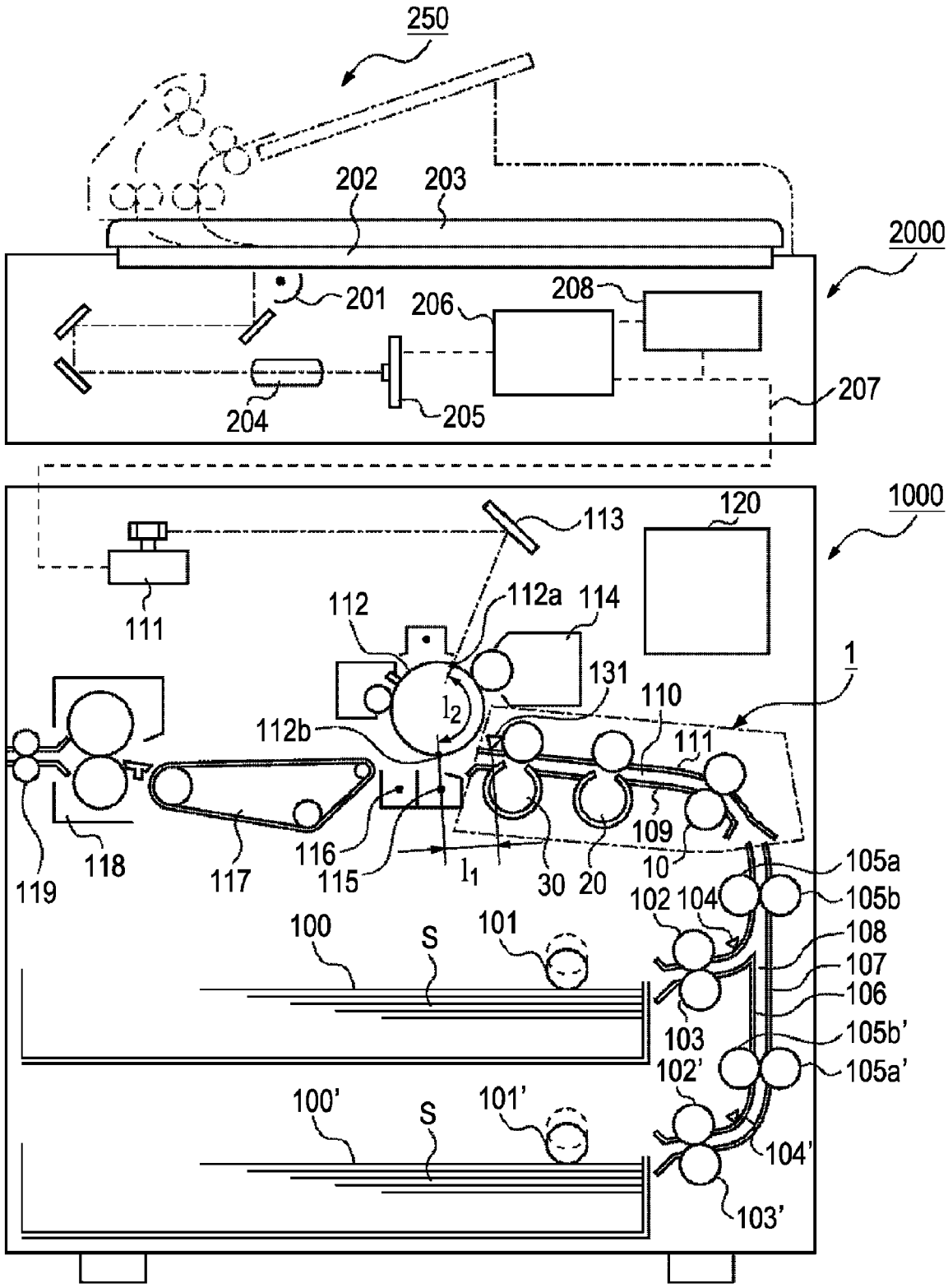
FIG. 1 is an overall configuration diagram of an example image forming apparatus including a sheet conveying apparatus according to a first exemplary embodiment of the present invention.

FIG. 1 is a cross-sectional view of a printer serving as an image forming apparatus to which a registration apparatus according to a first embodiment of the present invention is applied. In FIG. 1, reference numeral 1000 denotes a printer, 120 denotes a controller serving as a control unit configured to control the printer 1000. Reference numeral 100 is an upper cassette, sheets S stored in the upper cassette 100 are separated and fed one at a time by a sheet feeding unit made up of a pickup roller 101 configured to ascend/descend/rotate at predetermined timing, a feed roller 102, and a retard roller 103.

Subsequently, the sheet S fed from the sheet feeding unit is conveyed to a conveying path 108 made up of guide plates 106 and 107 by conveying roller pair 105*a* and 105*b*. The sheet S is conveyed to a registration portion 1 including a conveying path 110 where a bent conveying guide portion made up of guides 109 and 111 is disposed at the upstream side, an assistance roller pair (sheet conveying auxiliary portion) 10, a skew correction roller pair (skew correction portion) 20, and a lateral registration roller pair (lateral registration correction portion) 30. With the registration portion 1, the skew of the sheet S is corrected (subjected to leading registration correction), the misalignment in the width direction of the sheet S is corrected (subjected to lateral registration correction), and the sheet S is conveyed to an image forming portion.

Note that sheets S stored in the lower cassette 100' are separated and fed one at a time by a sheet feeding unit made up of a pickup roller 101' configured to ascend/descend/rotate at predetermined timing, a feed roller 102', and a retard roller 103'. Subsequently, the sheet S is conveyed to the registration portion 1 via the conveying path 108 by a conveying roller pair 105*a'* and 105*b'*.

Note that in the drawing reference numerals 104 and 104' denote sheet detection sensors configured to detect a sheet fed from each sheet feeding unit, and the conveying control of the sheet S to the registration portion 1 is performed based on the detection from these sensors.

Description will be made later in detail regarding the skew correction (leading registration correction) and misalignment correction (lateral registration correction) operations in the registration portion 1.

Next, description will be made regarding the image forming portion. Reference numeral 112 denotes a photosensitive drum, which is configured to rotate in the clockwise direction in the drawing. Reference numeral 111 denotes a laser modulator (laser scanner) serving as an image creating unit, the laser light from the laser modulator is turned back by a mirror 113, eliminated on an exposure position 112*a* on the photosensitive drum 112 to form a latent image, and this latent image is converted into a visual image by a developer 114. Reference numeral 115 denotes a transfer charger configured to transfer a toner image on the photosensitive drum 112 onto a sheet, and 116 denotes a separation charger configured to electrostatically separate between the drum and a sheet. Note that reference numeral 112*b* denotes a transfer portion where the toner image on the photosensitive drum 112 is transferred onto the sheet S.

The sheet S which has passed through the registration portion 1 is detected at the tip thereof by the registration sensor 131, and is conveyed in sync with an image conveyed distance $l_2$ from the laser light illumination position 112*a* to the transfer portion 112*b* of the photosensitive drum 112. That is to say, the position of the sheet S is corrected while the sheet S is conveyed distance $l_1$ from the registration sensor 131 to the transfer portion 112*b*, and transfer is performed by synchronizing the sheet S with the tip position of the image on the photosensitive drum 112.

Reference numeral 117 denotes a conveying belt configured to transfer a sheet member on which an image is formed, 118 denotes a fixer, and 119 denotes a discharge roller. The sheet S on which a toner image is transferred by the image forming portion is conveyed by the transfer belt 117, fixed with a toner image by the fixer 118, and discharged by the discharge roller 119.

Reference numeral 2000 denotes a document feeder 250 disposed above the printer 1000. In FIG. 1, reference numeral 201 denotes a scan optical light source, 202 denotes a platen glass, 203 denotes a document pressing plate which opens and closes, 204 denotes a lens, 205 denotes a light detector (photoelectric conversion), 206 denotes an image processing unit, and 208 denotes a memory unit configured to store an image processing signal processed by the image processing unit.

An original image scanned by the scan light source 201 is processed at the image processing unit 206, wherein the original image is electrically encoded and converted into an electric signal 207, and is conveyed to the laser modulator 111 serving as an image creating unit. Also, an arrangement is made wherein the image information processed and encoded at the image processing unit is temporarily stored in the memory 208, and can be conveyed to the laser modulator 111 in accordance with a signal from the controller 120 as necessary.

Description has been made wherein the printer 1000 and the scanner 2000 are separately provided, but the printer 1000 and the scanner 2000 may be integrated into one unit. The printer 1000 serves as a copier when the laser modulator 111 inputs the processing signal of the image forming portion, serves as a facsimile when inputting a facsimile signal, and serves as a printer when inputting an output signal of a personal computer, regardless of whether or not the printer 1000 is provided separately or integrally. In the event of mounting the document feeder 250 such as shown in a two-dot chain line instead of the pressing plate 203, originals are automatically scanned.

Figure 2:
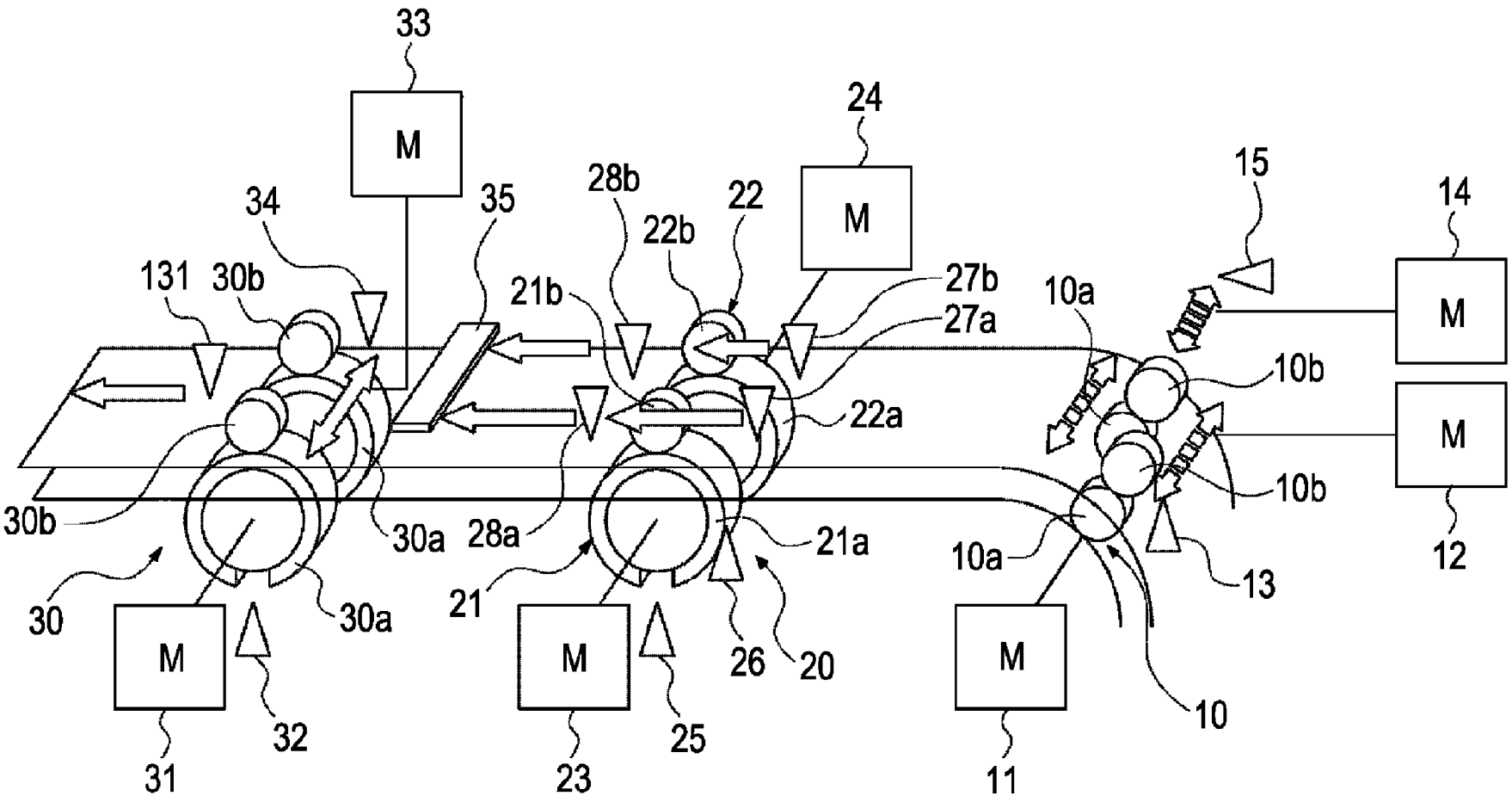
FIG. 2 is a schematic configuration diagram according to the first embodiment.
Figure 3:
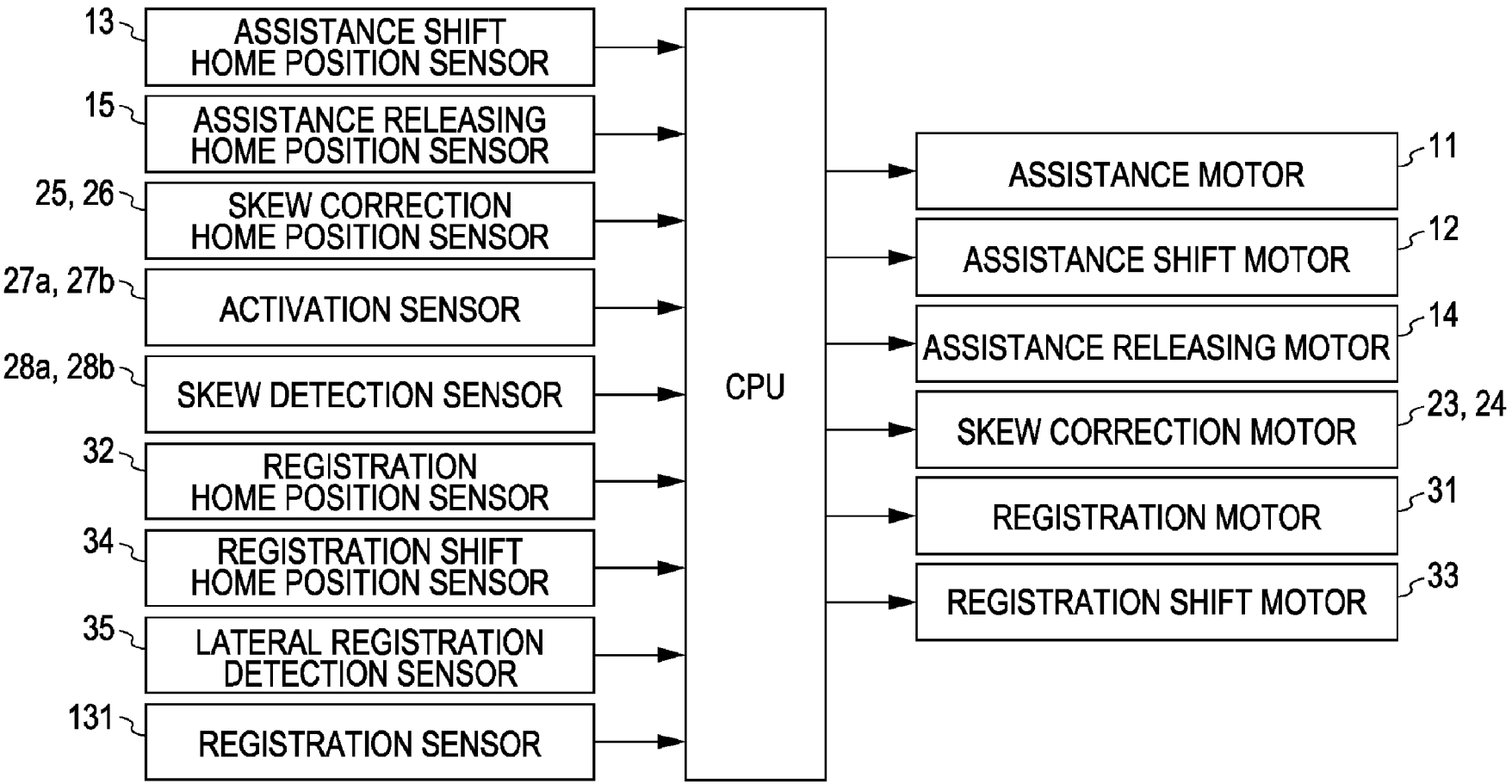
FIG. 3 is a block diagram according to the first embodiment.

Next, the details of the registration portion 1 will be described with reference to FIGS. 2 through 10. FIG. 2 is a schematic view illustrating a registration apparatus according to one embodiment of the present invention, and FIG. 3 is a block diagram.

In FIG. 2, the assistance roller pair 10, skew correction roller pair 20, and lateral registration roller pair 30 are supported pivotally to each lateral plate thereof by an unshown frame.

The assistance roller pair 10 making up a sheet conveying auxiliary portion is provided at a bent portion of the bent conveying guide portion formed at the upstream side of the conveying path 110. The assistance roller pair 10 is made up of an assistance driving roller 10*a*, and an assistance driven roller 10*b* pressed by an unshown pressing spring of the assistance driving roller 10*a*. The assistance driving roller 10*a* is connected with an assistance motor 11 which is driven with rotation to convey a sheet in the conveying direction. The assistance roller pair 10 is connected with an assistance shift motor 12 configured to move a sheet in the direction orthogonal to the sheet conveying direction (hereafter, referred to as sheet width direction). Also, an assistance shift home position sensor 13 is disposed, which is configured to detect the position of the assistance roller pair 10. Further, the assistance driven roller 10*b* is connected with an assistance releasing motor 14 configured to release pressing against the assistance driving roller 10*a*. Also, an assistance releasing home position sensor 15 is disposed, which is configured to detect the phase of the assistance releasing motor 14 to determine whether or not the assistance driven roller 10*b* is in a home position. The assistance releasing home position sensor 15 detects a state in which the assistance driven roller 10*b* is released from pressing against the assistance driving roller 10*a*.

The skew correction roller pair 20 making up the skew correction portion is made up of a skew correction roller pair 21 and 22 serving as a two-sheet conveying solid of rotation pair disposed in the sheet width direction with a predetermined interval $L_{RP}$. The skew correction roller pair 21 and 22 are made up of C-type shaped skew correction rollers 21*a* and 22*a*, and skew correction driven rollers 21*b* and 22*b* which are pressed with an unshown pressing spring by the skew correction driving rollers 21*a* and 22*a*, respectively. The skew correction driving rollers 21*a* and 22*a* are connected with skew correction motors 23 and 24 configured to independently drive the skew correction driving rollers 21*a* and 22*a* respectively. According to the skew correction motors 23 and 24, the skew correction driving rollers 21*a* and 22*a* convey the sheet S by changing the sheet conveying velocity thereof, thereby rotating the sheet S to correct the skew thereof.

Figure 10:
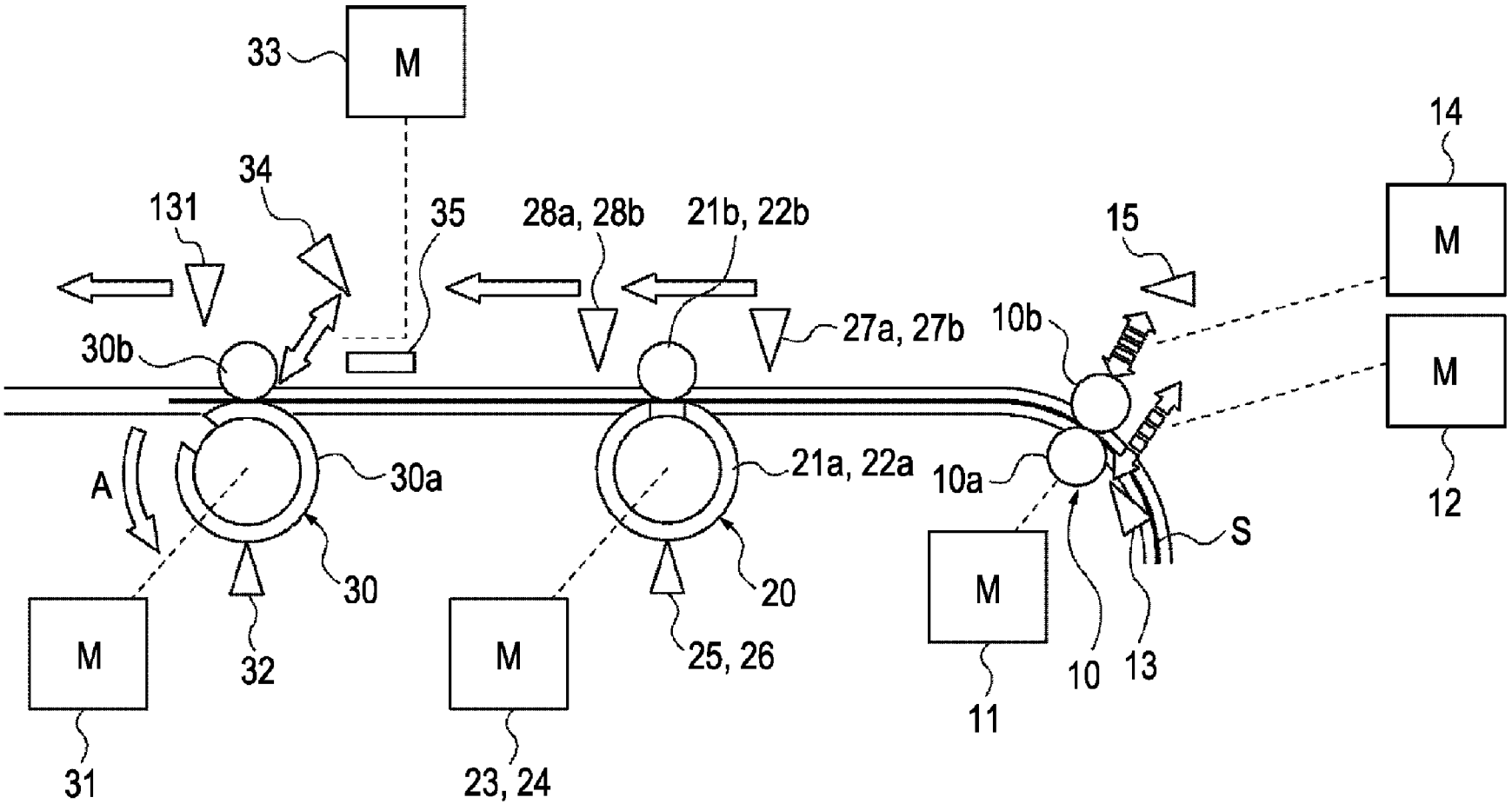
FIG. 10 is an operation explanatory diagram in the cross-sectional direction according to an example lateral registration and leading registration correction of the first embodiment.

Skew correction home position sensors 25 and 26 are disposed, which are configured to detect the phase of the rotating direction of each of the skew correction driving rollers 21*a* and 22*a* to determine whether or not the skew correction driving rollers 21*a* and 22*a* are in a home position. The home positions of the skew correction driving rollers 21*a* and 22*a* are, as shown in FIG. 10, a state in which notched portions of the circumferential surfaces of the skew correction driving rollers 21*a* and 22*a* face the skew correction driven rollers 21*b* and 22*b*. This state is a state in which pressing (nip) is released between the rollers of the skew correction driving rollers 21*a* and 22*a*, and the skew correction driven rollers 21*b* and 22*b*, and a gap where a sheet is not restricted is formed between the skew correction driving rollers 21*a* and 22*a*, and the skew correction driven rollers 21*b* and 22*b*.

Activation sensors 27*a* and 27*b* serving as a first skew detection portion configured to activate the driving motors 23 and 24 are disposed with a predetermined interval $L_{RP}$ in the direction orthogonal to the sheet conveying direction at the upstream side in the conveying direction of the registration roller pair 20. The driving motors 23 and 24 are activated in sync with the detection of the tip of the sheet S by the activation sensors 27*a* and 27*b*.

Figure 6:
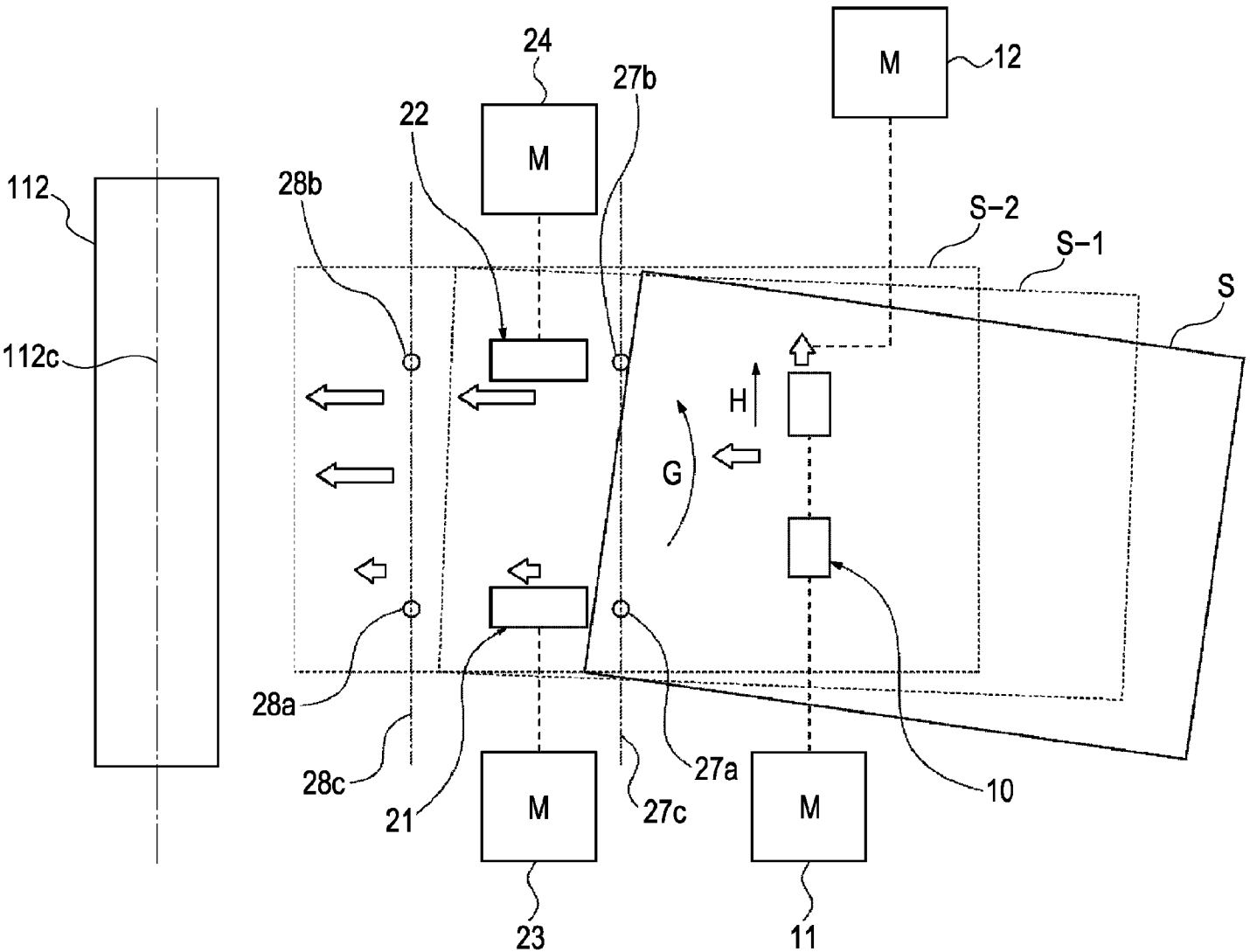
FIG. 6 is an operation explanatory diagram at the upper surface direction according to the example skew correction of the first embodiment.

Further, skew detection sensors 28*a* and 28*b* serving as a second skew detection portion configured to detect the skew of the sheet S are disposed with a predetermined interval $L_{RP}$ in the sheet width direction at the downstream side in the conveying direction of the registration roller pair 20. Note that, as shown in FIG. 6, center lines 27*c* and 28*c* connecting the activation sensors 27*a* and 27*b* with the skew detection sensors 28*a* and 28*b* are disposed so as to be in parallel with the shaft line 112*c* of the photosensitive drum 112 provided at the downstream side in the conveying direction.

Figure 5:
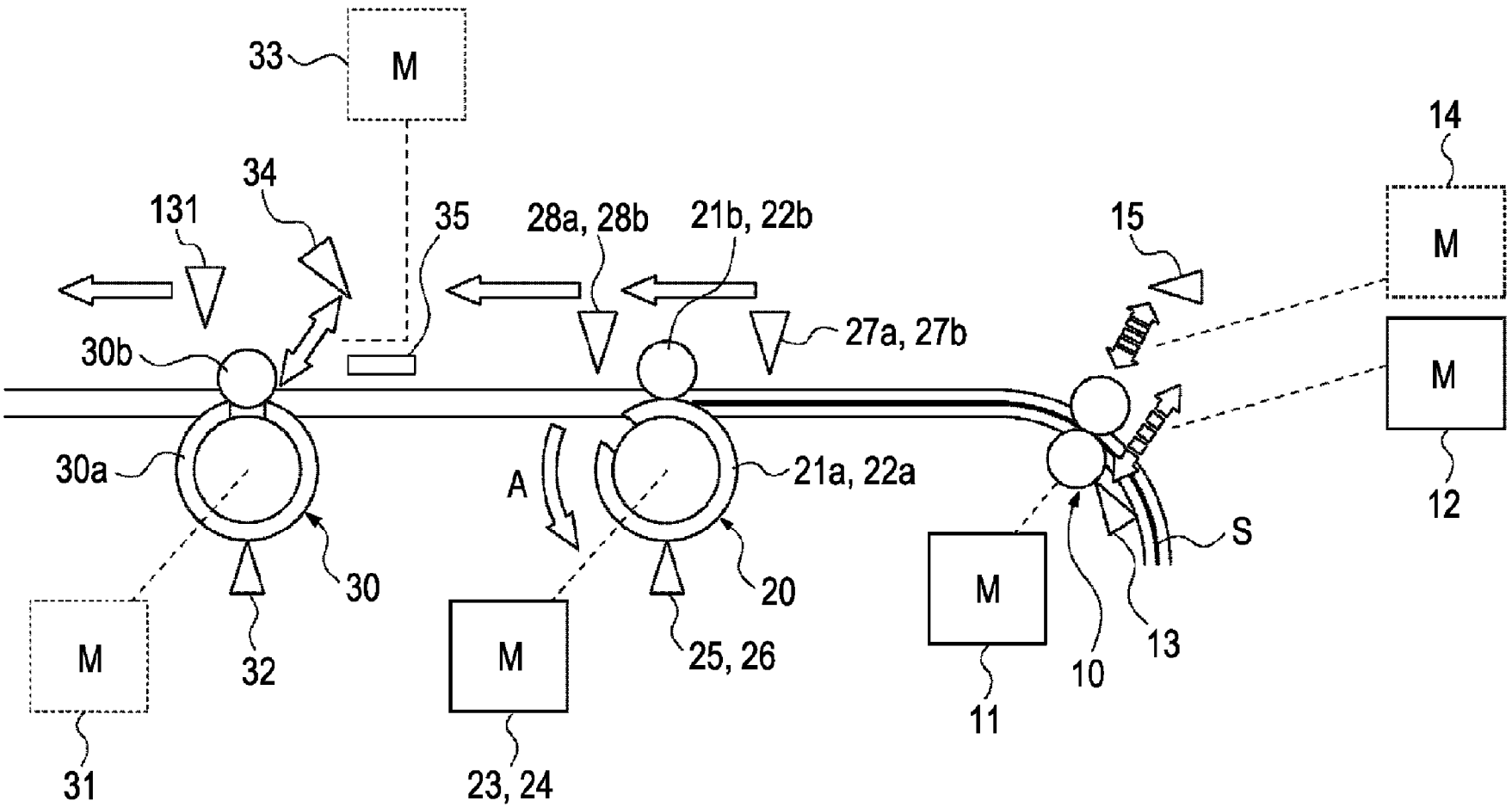
FIG. 5 is an operation explanatory diagram in the cross-sectional direction according to an example skew correction of the first embodiment.

Two sets of lateral registration roller pairs 30 making up a lateral registration correction portion are provided in the sheet width direction, each of which is made up of a registration driving roller 30*a* having a C-type shape, and a registration driven roller 30*b* pressed by an unshown pressing spring. As shown in FIG. 5, in a state in which a notched portion of the circumferential surface of the registration driving roller 30*a* faces the registration driven roller 30*b*, the pressing (nip) between the rollers of the registration driving roller 30*a* and the registration driven roller 30*b* is released, and a gap where a sheet is not restricted is formed between the registration driving roller 30*a* and the registration driven roller 30*b*.

The registration driving roller 30*a* is connected with a registration motor 31 configured to drive the registration driving roller 30*a* in the sheet conveying direction. Also, a registration home position sensor 32 is disposed, which is configured to detect the phase of the lateral registration roller pair 30. The lateral registration roller pair 30 is connected with a registration shift motor 33 configured to move the lateral registration roller pair 30 in the sheet width direction. Also, a registration shift home position sensor 34 is disposed, which is configured to detect whether or not the position in the sheet width direction of the lateral registration roller pair 30 is a home position. Note that the apparatus according to the present embodiment is an apparatus configured to convey the sheet S with the center as reference, so the lateral registration roller pair 30 shifts the sheet S such that the center in the width direction of the sheet S to be corrected is in the center reference position.

A lateral registration detection sensor 35 is disposed in the direction orthogonal to the sheet conveying direction at the upstream side in the conveying direction of the lateral registration roller pair 30, which is configured to detect the lateral registration position of the sheet S. A registration sensor 131 is disposed downstream of the lateral registration roller pair 30, which is configured to detect the tip of the sheet S to be conveyed.

FIG. 3 is a block diagram of the controller unit 120, wherein detection information from each sensor is input to the CPU. Subsequently, the CPU transmits a driving signal to each motor to perform later-described each control as appropriate.

Figure 4:
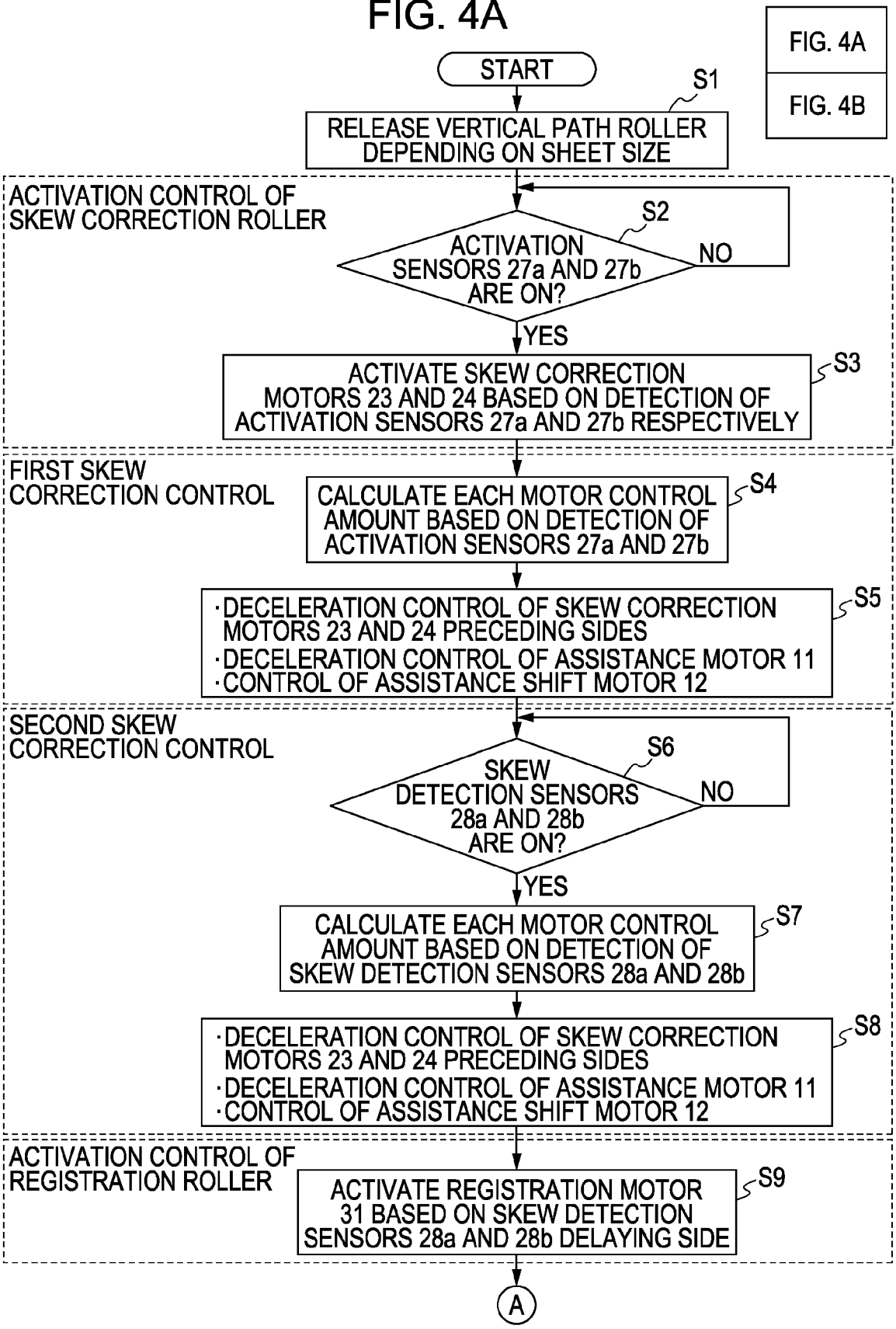
FIG. 4 is a control flowchart according to the first embodiment.
Figure 4B:
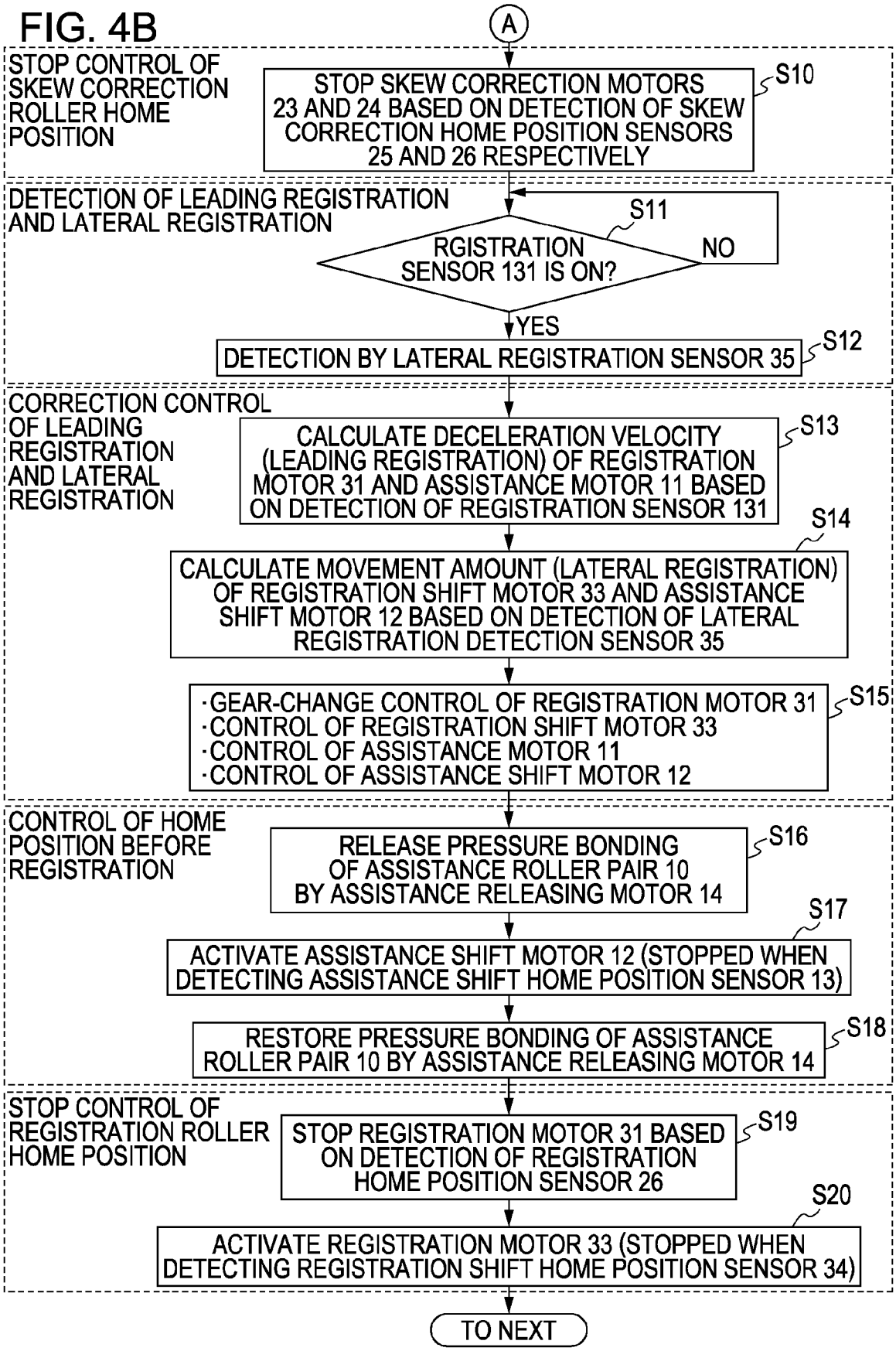
Figure 11:
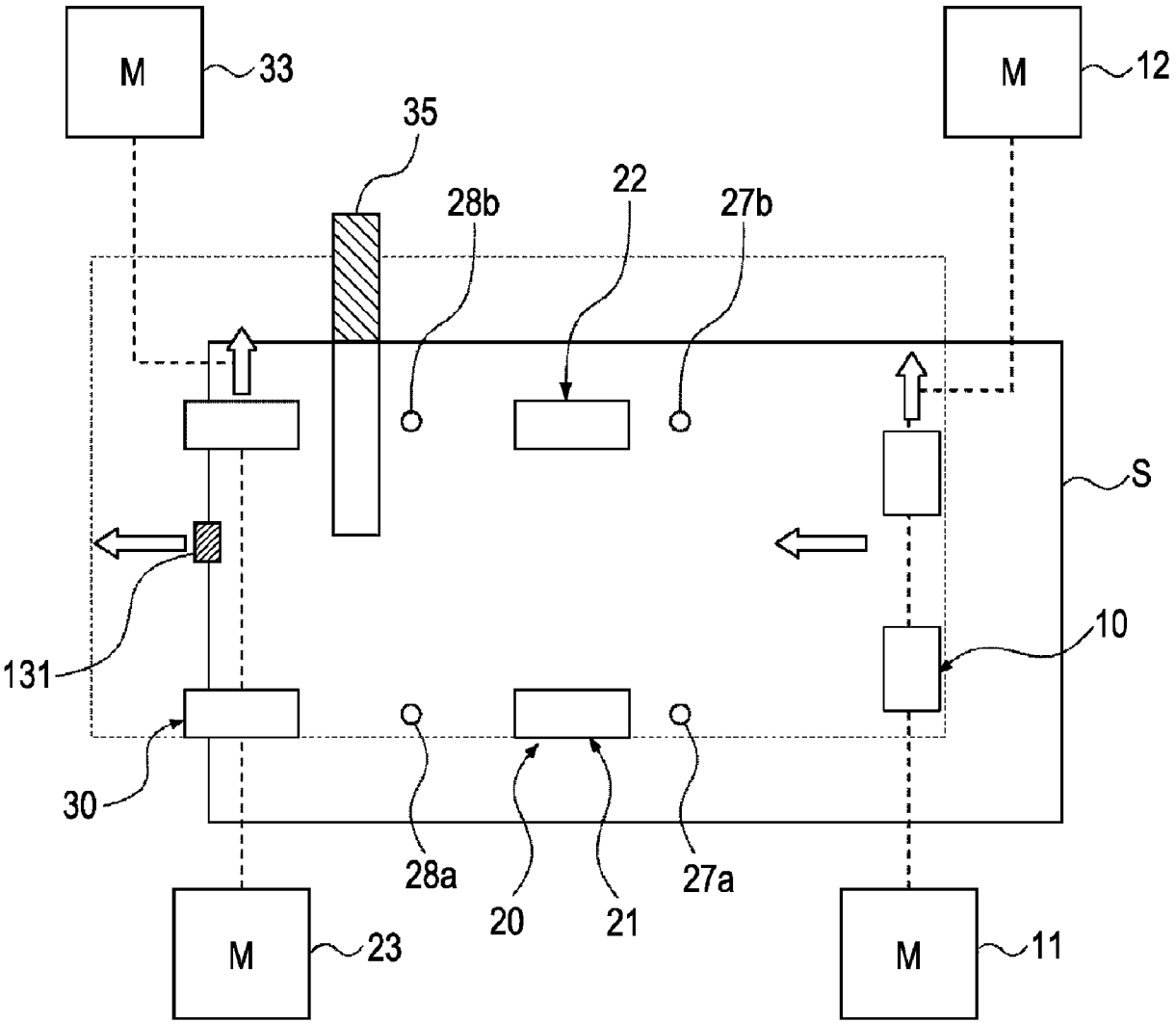
FIG. 11 is an operation explanatory diagram at the upper surface direction according to the example lateral registration and leading registration correction of the first embodiment.
Figure 12:
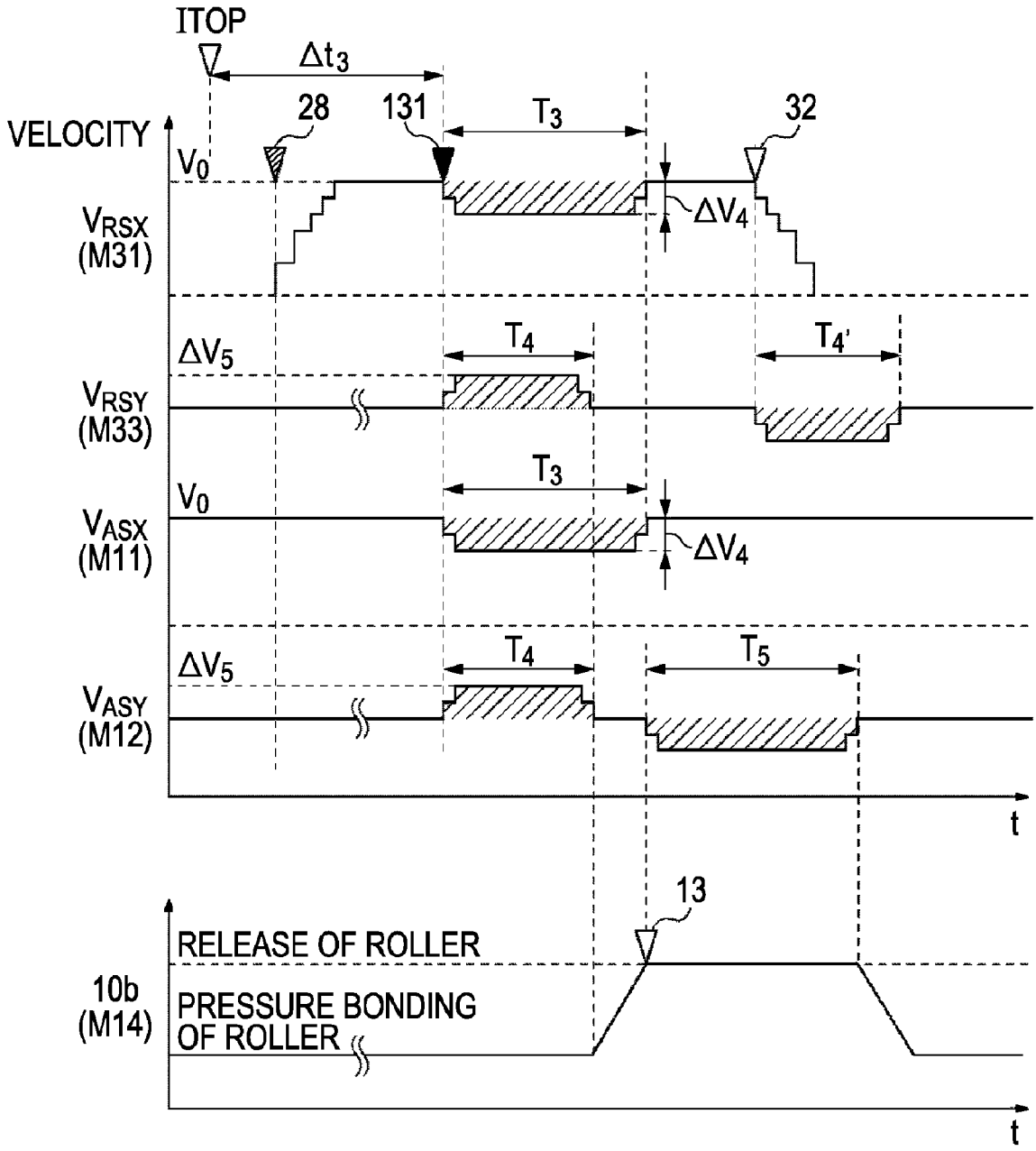
FIG. 12 is a motor operation explanatory diagram according to the example lateral registration and leading registration correction of the first embodiment.

Next, description will be made regarding a correction operation at the registration portion with reference to FIGS. 4 through 12. FIG. 4 is a flowchart illustrating a schematic operation, FIGS. 5 through 9 are schematic diagrams illustrating a skew correction operation, and FIGS. 10 through 12 are schematic diagrams illustrating a leading registration and lateral registration correction operation. A schematic operation will be described in accordance with the flowchart shown in FIG. 4. The sheet S supplied from the cassette 100 and 100' is conveyed to the assistance roller pair 10 by the conveying roller pair 105*a* and 105*b*. At the assistance roller pair 10, the driven roller 105*b* is released from the pressurization of the driving roller 105*a* by an unshown roller releasing motor as necessary depending on the size of a sheet (Step 1 or "S1" and similar for the remaining steps). When the activation sensors 27*a* and 27*b* detect the tip of the sheet S conveyed by the assistance roller pair 10 (Step 2), the skew correction motors 23 and 24 are activated based on the detection of each sensor (Step 3). Subsequently, the skew correction driving rollers 21*a* and 22*a* of the skew correction roller pair 21 and 22 whose pressing against the rollers have been released rotation in the direction A in FIG. 5 to convey the sheet S.

Figure 8:
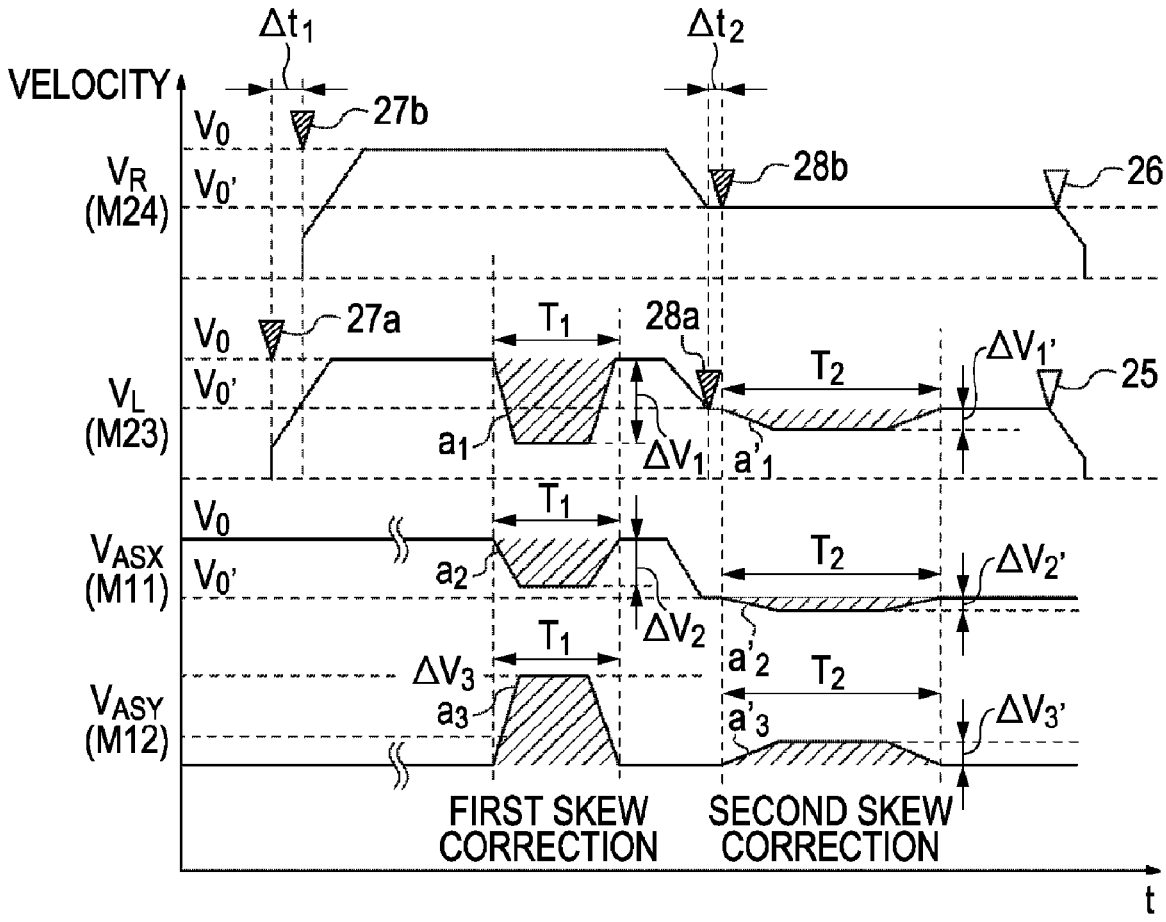
FIG. 8 is a motor operation explanatory diagram according to the example skew correction of the first embodiment.

As shown in the operation explanatory diagram of each motor shown in FIG. 8, the amount of skew of the sheet S tip is calculated from the detection time difference $\Delta t_1$ of the activation sensors 27*a* and 27*b*. Subsequently, in the event that the activation sensor 27*a* is detected first, the sheet conveying velocity of the skew correction roller pair 21 (correction motor 23) is decelerated, and correction time $T_1$ and deceleration velocity $\Delta V_1$ which are control parameters arranged to perform skew correction are calculated so as to satisfy the following expression.

$$V_0 \times \Delta t_1 = \int_{T_1} \Delta V_1 dt \quad [3]$$

Figure 7:
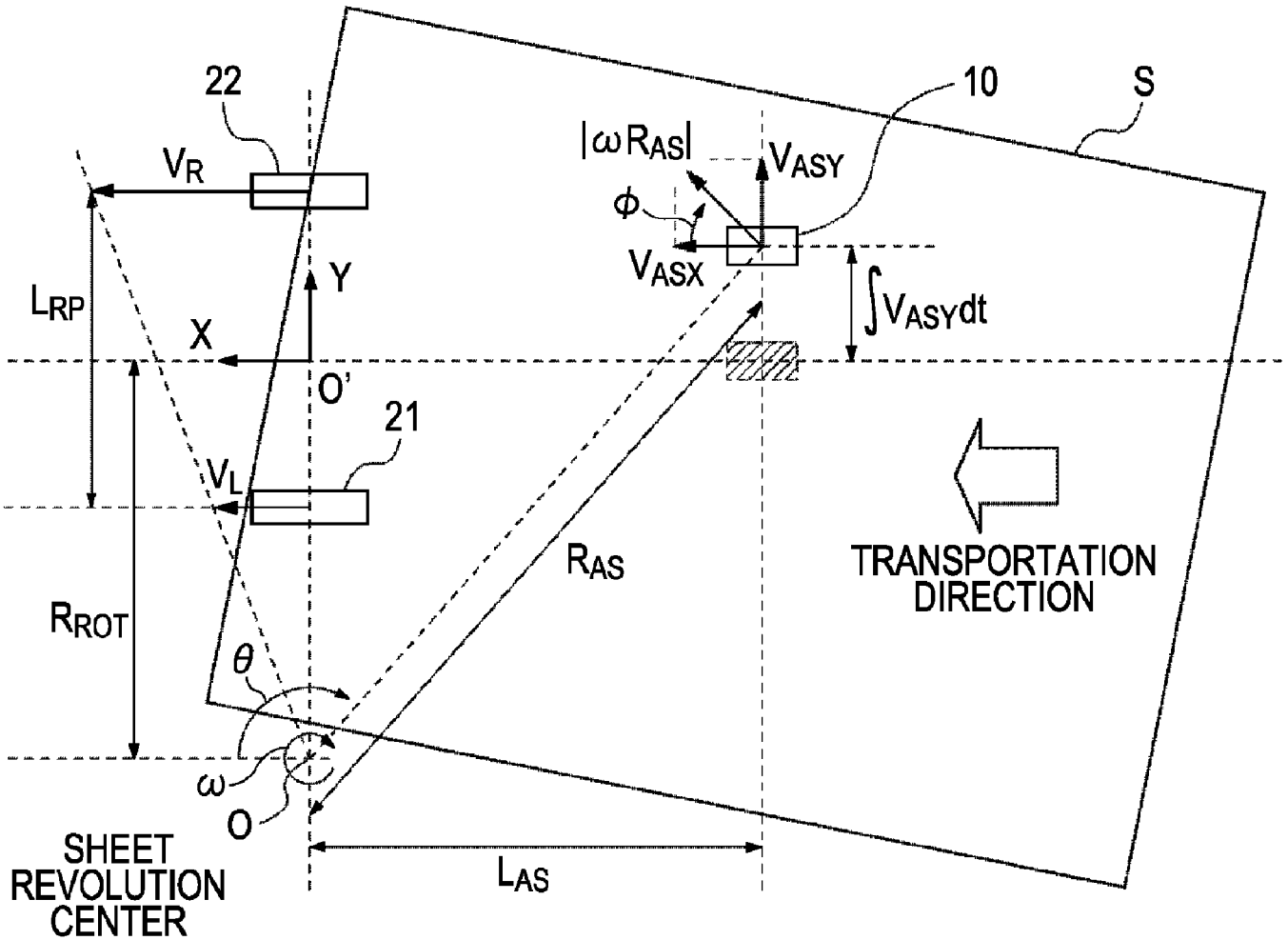
FIG. 7 is an operation parameter explanatory diagram at the upper surface direction according to the example skew correction of the first embodiment.

Also, the velocity in the conveying direction of the assistance rollers is obtained from the relation shown in FIG. 7. When assuming that the conveying velocity at the time of correction by the correction rollers 21 and 22 are $V_L$ and $V_R$, the thrust pitch between the correction rollers is $L_{RP}$, and the rotation velocity at the rotation center o of the sheet S is ω, $$\omega = \frac{V_R - V_L}{L_{RP}} \quad [4]$$

holds.

When assuming that the rotation distance from the rotation center o of the sheet S to the center point o' between the correction rollers 21 and 22 is $R_{ROT}$, according to "$R_{ROT} \cdot \omega \equiv (V_L+V_R)/2$", $$R_{ROT} = \frac{V_L + V_R}{2|V_R - V_L|} \cdot L_{RP} \quad [5]$$

holds.

When assuming that the conveying direction velocity of the assistance roller pair 10 is $V_{ASX}$, thrust direction velocity of the assistance roller pair 10 is $V_{ASY}$, the distance from the correction roller pair 21 and 22 to the assistance roller pair 10 is $L_{AS}$, and the rotation distance from the rotation center o of the sheet S to the assistance roller pair 10 is $R_{AS}$, $$R_{AS} = \sqrt{L_{AS}^2 + (R_{ROT} + \int V_{ASY} dt)^2} \quad [6]$$

holds.

When assuming that the angle between the rotation center o of the sheet S and the assistance roller pair 10 is θ, and the angle between the conveying direction velocity $V_{ASX}$ of the assistance roller pair 10 and the synthesis conveying velocity $|\omega R_{AS}|$ of the sheet S is ϕ, $$\phi = \theta - \pi/2 \quad [7]$$

holds.

Thus, with the conveying direction velocity $V_{ASX}$ and thrust direction velocity $V_{ASY}$ of the assistance roller pair 10, the following relational expressions hold.

$$\begin{aligned} V_{ASX} &= |\omega R_{AS}| \cdot \cos\phi \\ &= \left|\omega \cdot \left(R_{ROT} + \int V_{ASY} dt\right)\right| \\ &= \frac{V_L + V_R}{2} + \frac{|V_L - V_R| \cdot \int V_{ASY} dt}{L_{RP}} \end{aligned} \quad [8]$$

$$V_{ASY} = -\omega R_{AS} \cdot \sin\phi = -\omega L_{AS} = \frac{L_{AS}}{L_{RP}}(V_L - V_R) \quad [9]$$

In the event that the amount of skew is sufficiently small, $$\int V_{ASY} dt \cong 0 \quad [10]$$

approximation can be made thus, whereby $$V_{ASX} \cong \frac{V_L + V_R}{2},\ V_{AST} \cong \frac{L_{AS}}{L_{RP}}(V_L - V_R) \quad [11]$$

hold.

Therefore, according to the functional expression of the following Expression (4), each velocity of the correction motor 23, assistance motor 11, and assistance shift motor 12 can be calculated.

$$\Delta V_2 \approx \Delta V_1/2,\ \Delta V_3 \approx \Delta V_1 \times L_{AS}/L_{RP} \quad \text{Expression (4)}$$

On the other hand, as described above, according to the difference $|\Delta d_{Lx} - \Delta d_{Rx}|$ of the slip amount of the skew correction roller pair 21 and 22, skew correction accuracy can be represented with the following expression.

$$|\Delta d_{Lx} - \Delta \Delta d_{Rx}| \approx k(|F_{Lx} V_L F_{Rx} V_R / F_{max})\tau \quad \text{Expression (3)}$$

Also, the conveying force $F_{Lx}$ and $F_{Rx}$ according to the skew correction roller pair 21 and 22 in the steady-state velocity of the above-mentioned Expression (4) are, as described above, $$F_{Lx} = -1/2 \cdot [1 - 2/L_{RP} \cdot \{(X^2+Y^2)/Y \cdot RROT\} \cdot F_{BTx} \quad \text{Expression (1)}$$

$$F_{Rx} = -1/2 \cdot [1 + 2/L_{RP} \cdot \{(X^2+Y^2)/Y \cdot RROT\} \cdot F_{BTx} \quad \text{Expression (2)}$$

On the other hand, the conveying load (back tension) $F_{BT}$ can be classified into steady-state conveying resistance components $F_{BT1}$ by the conveying guide, and gearshift conveying resistance components $F_{BT2}$ generated during deceleration, as shown in the following expression.

$$F_{BT} = F_{BT1} + F_{BT2} = F_{BT1} + k' \cdot a \quad \text{Expression (5)}$$

Wherein $F_{BT2}$ is a proportional expression employing a constant k' when assuming that the acceleration during conveying of the sheet S is a, as shown in the above expression.

Also, the sheet S is made up of paper fibers, generally has features as a viscoelastoplastic member, and particularly upon a sheet of thick paper being conveyed to the bent conveying guide portion upstream of the registration portion at high velocity, the conveying load $F_{BT}$ as to the sheet increases drastically. When assuming that conveying velocity is V, the coefficient of viscosity is c, and a constant is k", the conveying load $F_{BT}$ is $$F_{BT} = cV + k'' \quad \text{Expression (6)}$$

Consequently, in order to improve skew correction accuracy, it is necessary to infinitely reduce the velocity difference $\Delta V$ between the conveying velocity $V_L$ and $V_R$ of the skew correction roller pair 21 and 22 at skew correction time τ in Expression (3) (equivalent to that the rotation radius $R_{ROT}$ needs to be increased), and accordingly, it is necessary to further reduce the movement amount of the sheet S to be corrected. At this time, it is also necessary to reduce the force difference as to the force $F_{Lx}$ and $F_{Rx}$ applied to the skew correction roller pair 21 and 22 at the skew correction time $\tau$ in Expression (3), which is realized by decreasing the conveying velocity difference $\Delta V$, and increasing the rotation radius $R_{ROT}$, according to Expressions (1) and (2). Further, additionally, according to Expression (5), it is necessary to reduce the acceleration a at the time of correction by the skew roller pair 21 and 22 as small as possible, and according to Expression (6), it is necessary to reduce the conveying velocity $V_L$ and $V_R$ of the skew correction roller pair 21 and 22, and also the conveying load $F_{BT}$ as small as possible. On the other hand, in order to reduce the apparatus in size, it is necessary to reduce the skew correction time $\tau$ as small as possible.

Figure 9:
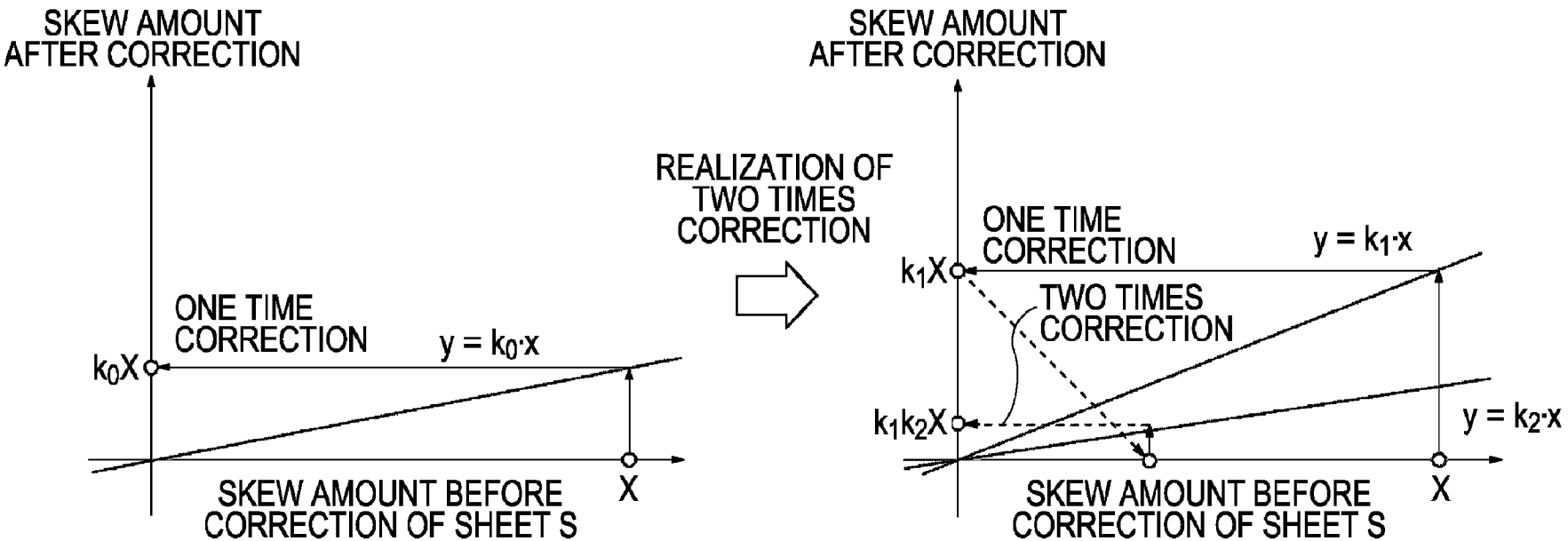
FIG. 9 is an explanatory diagram of skew correction accuracy according to skew correction of the first embodiment.

Now, FIG. 9 is a conceptual view of skew correction accuracy employing skew correction according to the present embodiment, wherein the skew of the sheet S is not corrected by one time skew correction, but is corrected accurately in a short period of time by two times skew correction whose settings differ.

The first skew correction is arranged to be the setting of rough skew correction accuracy wherein the skew of the sheet S is reduced to a predetermined skew amount or less in short correction distance and in short correction time as short as possible. Also, the second skew correction is arranged to be the setting of high skew correction accuracy wherein the skew of the sheet S is reduced to a predetermined skew amount or less in long correction distance and in long correction time as long as possible. That is to say, with the first skew correction, the great amount of skew is corrected in a short period of time, and accordingly, slip increases, but with the second skew correction, the small amount of skew is corrected in a long period of time, and accordingly, slip decreases, whereby skew correction accuracy can be improved.

Therefore, when assuming that with the first skew correction, the conveying velocity is $V_0$, conveying velocity difference is $\Delta V$, acceleration is a, and correction time is T, but on the other hand, with the second skew correction, the conveying velocity is $\Delta V_0'$, conveying velocity difference $\Delta V'$, acceleration is a', and correction time is T', the parameter settings are preformed such as the following.

$$V_0 >> V_0',\ \Delta V >> \Delta V',\ a >> a',\ T >> T' \qquad \text{Expression (7)}$$

Thus, of the first and second skew correction, the conveying velocity, conveying velocity difference, and acceleration are increased with the first skew correction, and the correction time is prolonged with the second skew correction. Thus, a great number of skew amount is corrected in a short period of time with the first skew correction, and high-precision skew correction is performed with the second skew correction, whereby high-precision skew correction can be completed.

Now referring back to FIG. 4 and as described above, according to Expressions (4) and (7), various types of control parameters arranged to perform skew correction are calculated (Step 4). The skew correction motor 23 performs the first skew correction by decelerating by $\Delta V_1$ at acceleration $a_1$ from the conveying velocity $V_0$ at a first skew correction zone ($T_1$), and accelerating again up to the conveying velocity $V_0$ at the time of the end of the skew correction zone. At this time simultaneously, the assistance motor 11 decelerates by $\Delta V_2$ at acceleration $a_2$ from the conveying velocity $V_0$, and accelerates again up to the conveying velocity $V_0$ at the time of the end of the skew correction zone. The assistance shift motor 12 accelerates up to $\Delta V_3$ at acceleration $a_3$, and stops at the time of the end of the skew correction zone. As described above, as shown in FIG. 8, the skew correction motor 23, assistance motor 11, and assistance shift motor 12 are controlled, thereby performing the first skew correction ($T_1$) (Step 5).

At this time, the skew correction driving rollers 21*a* and 22*a* have the same roller phase. In other words, the portion where the circumferential surface is notched of each of the skew correction driving rollers 21*a* and 22*a* is in the same direction.

Following completion of the first skew correction of the sheet S, the conveying velocity of the skew correction motors 23 and 24, and assistance motor 11 are decelerated from $V_0$ to $V_0'$. As shown in FIG. 6, the sheet S greatly skewed is corrected such as a state S-1. Subsequently, the amount of skew of the sheet S is detected by the downstream skew detection sensors 28*a* and 28*b* (Step 6), and as with the first skew correction, various types of control parameters arranged to perform skew correction are calculated (Step 7), and the second skew correction ($T_2$) is performed (Step 8). Thus, as shown in FIG. 6, the skew of the sheet S is completely corrected in a state S-2.

Thus, the sheet conveying velocity differences due to the skew correction driving rollers 21*a* and 22*a* are changed between the first skew correction and the second skew correction. In other words, the amount of skew correction at the time of the first skew correction of a sheet is set so as to be greater than the amount of skew correction at the time of the second skew correction of the sheet in a short period of time. Thus, a sheet is rotated with fast rotation velocity at the time of the first skew correction to perform rough skew correction, and the sheet is rotated with slower rotation velocity than the first time at the time of the second skew correction to perform high-precision skew correction.

The sheet S whose skew state was corrected by the skew correction roller pair 21 and 22 is conveyed to the lateral registration roller pair 30. With the lateral registration roller pair 30, the registration motor 31 is activated based on the delayed side of the skew detection sensors 28*a* and 28*b* (Step 9), and the lateral registration roller pair 30 whose rollers have been released from pressing (nip) is rotated (in the direction A in FIG. 10) to convey the sheet S. Upon the sheet S being pinched by the lateral registration roller pair 30, the skew correction motors 23 and 24 stop in a state in which the pressing of the rollers of the skew correction roller pair 21 and 22 is released as shown in FIG. 10 based on each of the skew correction home position sensors 25 and 26 (Step 10).

Upon the tip of the sheet S being detected by the registration sensor 131 (Step 11), at the same time the lateral edge position of the sheet S is detected by the lateral registration sensor 35 (Step 12). The time difference $\Delta T_3$ between the detection timing of the registration sensor 131 and the timing of laser light being irradiated on the photosensitive drum 112 (ITOP) is detected. Based on this time difference, an image tip conveyed distance $l_0$ from the laser light irradiation position 112*a* of the photosensitive drum 112 to the transfer portion 112*b*, and the sheet S tip conveyed distance $l_1$ from the registration sensor 131 to the transfer portion 112*b* are aligned. Subsequently, the deceleration velocity $\Delta V_4$ and gearshift time $T_3$ of the registration motor 31 and the assistance motor 11 are calculated (Step 13).

Also, in order to synthesize the lateral registration position of an image on the photosensitive drum 112 with the lateral position of the sheet S based on the detection signal of the lateral registration sensor 35, the velocity $\Delta V_5$ in the shift direction and the gearshift time $T_4$ of the registration shift motor 33 and assistance shift motor 12 are calculated (Step 14).

Subsequently, the registration motor 31, registration shift motor 33, assistance motor 11, and assistance shift motor 12 are controlled, whereby the image position on the photosensitive drum 112, and the tip position and lateral registration position of the sheet S are aligned (Step 15). Note that when the lateral registration roller pair 30 and assistance roller pair 10 after skew correction are moved in the shaft direction, the place where the circumferential surface of the skew correction driving rollers 21*a* and 22*a* of the skew correction roller pair 21 and 22 are notched is in a state of facing the skew correction driven rollers 21*b* and 22*b*. Thus, the sheet S is positioned in a gap between the skew correction driving rollers 21*a* and 22*a*, and the skew correction driven rollers 21*b* and 22*b*, so there is no restriction as to the sheet S.

Thus, when the lateral registration roller pair 30 shits in the shaft direction to regulate the lateral registration position based on the detection of the registration sensor 131, in sync with this the assistance roller pair 10 also shifts in the same direction as the movement direction of the lateral registration roller pair 30. Thus, the sheet S can be prevented from occurrence of a twist at the time of a lateral registration correction operation.

Upon the shift operation of the sheet S being completed, the driven roller 10*b* of the assistance roller pair 10 is released from the pressing by the assistance releasing motor 14 (Step 16). Upon the pressing release of the roller of the assistance roller pair 10 being detected by the assistance releasing home position sensor 15, the assistance shift motor 12 is activated, which shift-moves in the opposite direction of Step 15, and stops at the time of the detection of the assistance home position sensor 13 (Step 17). At this time, the assistance roller pair 10 moves in the shift direction equivalent to the first and second skew correction and the lateral registration correction, so the assistance shift motor 12 shift-moves by $T_5$ at the maximum movement velocity which can be driven. Subsequently, the assistance roller pair 10 is pressure-bonded again by the assistance releasing motor 14 at the position where the trailing edge of the sheet S passes through the assistance roller pair 10 (Step 18).

The sheet S conveyed by the lateral registration roller pair 30 is transfer-absorbed by the photosensitive drum 112, and the registration motor 31 is stopped based on the detection of the registration home position sensor 26 in a state in which the pressing of the roller of the lateral registration roller pair 31 is released (Step 19). Simultaneously with this, the registration shift motor 33 is activated, which shift-moves in the opposite direction of the shift direction in Step 15, and stops at the time of the detection of the registration shift home position sensor 34 (Step 20). A state in which the lateral registration roller pair 31 stops is a state in which the place where the circumferential surface of the registration driving roller 30*a* is notched faces the registration driven roller 30*b*, so the pressing (nip) of the roller is released. Therefore, the sheet S is not fed in by force, so there is no case wherein a poor image such as image blur or the like is caused at the photosensitive drum 112.

The above-mentioned Step 1 through Step 20 are repeated, thereby enabling the skew correction of the sheet S, and the positional correction between an image on the drum 112 and the sheet S to be performed accurately continuously.

Second Exemplary Embodiment

With the first embodiment, description has been made regarding the first roughly skew correction setting and the second high-precision skew correction setting by employing the driving control of the skew correction motors 23 and 24 and so forth. Now, description will be made regarding the first roughly skew correction setting and the second high-precision skew correction setting by employing the configurations of the skew correction roller pair 21 and 22 with reference to FIGS. 13 through 16. Note that apparatus configurations and control which will not be described below have the same as those in the first embodiment, so description thereof will be omitted.

Figure 13:
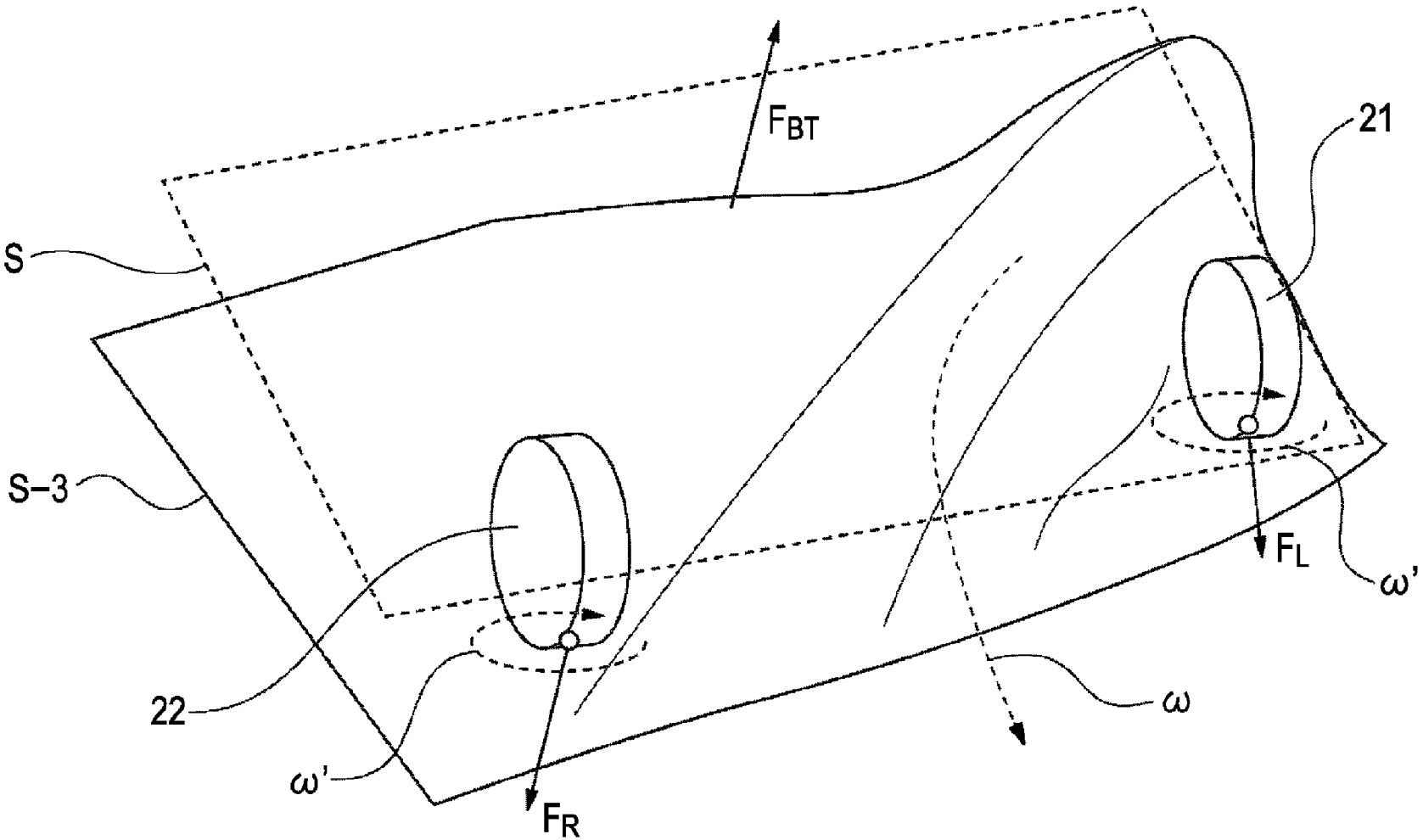
FIG. 13 is a schematic behavior explanatory diagram between a skew correction roller according to a second exemplary embodiment and a sheet.

FIG. 13 is a behavior schematic explanatory diagram between the skew correction roller pair 21 and 22, and the sheet S, wherein the sheet S is rotated in the ω direction, and is subjected to skew correction by the skew correction roller pair 21 and 22. At this time, the conveying force $F_L$ and $F_R$ from the correction roller pair 21 and 22, and the conveying resistance $F_{BT}$ applied to the sheet S are balanced on generally three points.

However, the skew correction roller pair 21 and 22 have a predetermined roller width, so the sheet portion nipped and restrained by the pressing portion (nip portion) of each roller fails to rotate, and attempts to rotate in the ω' direction which is the opposite direction of the ω direction within the restrained pressing portion (nip portion). Thus, distortion is applied to the sheet S, and a subtle slip is caused at each of the skew correction roller pair 21 and 22 during skew correction of the sheet S by the skew correction roller pair 21 and 22 so as to eliminate this distortion, and consequently, skew correction accuracy is deteriorated.

Also, in the worst case, as shown as S-3, a sheet is greatly distorted between the skew correction roller pair 21 and 22. Such a phenomenon frequently depends on the type of sheet. For example, such a phenomenon is readily caused in a condition wherein the width of the skew correction roller is great, and also the pressure of the pressing of the roller is high, a condition wherein the rigidity of the roller is low, the thickness of the roller (thickness in the radial direction) is thick, which is readily deformed, and the contact area of the sheet S is great, or in a condition wherein the frictional coefficient of the surface of the roller is drastically high.

Now, description will be made regarding the configuration of the skew correction roller configured to eliminate the distortion of the sheet S, and the deterioration in skew correction accuracy accompanied with that with reference to FIGS. 14 and 15.

Figure 14:
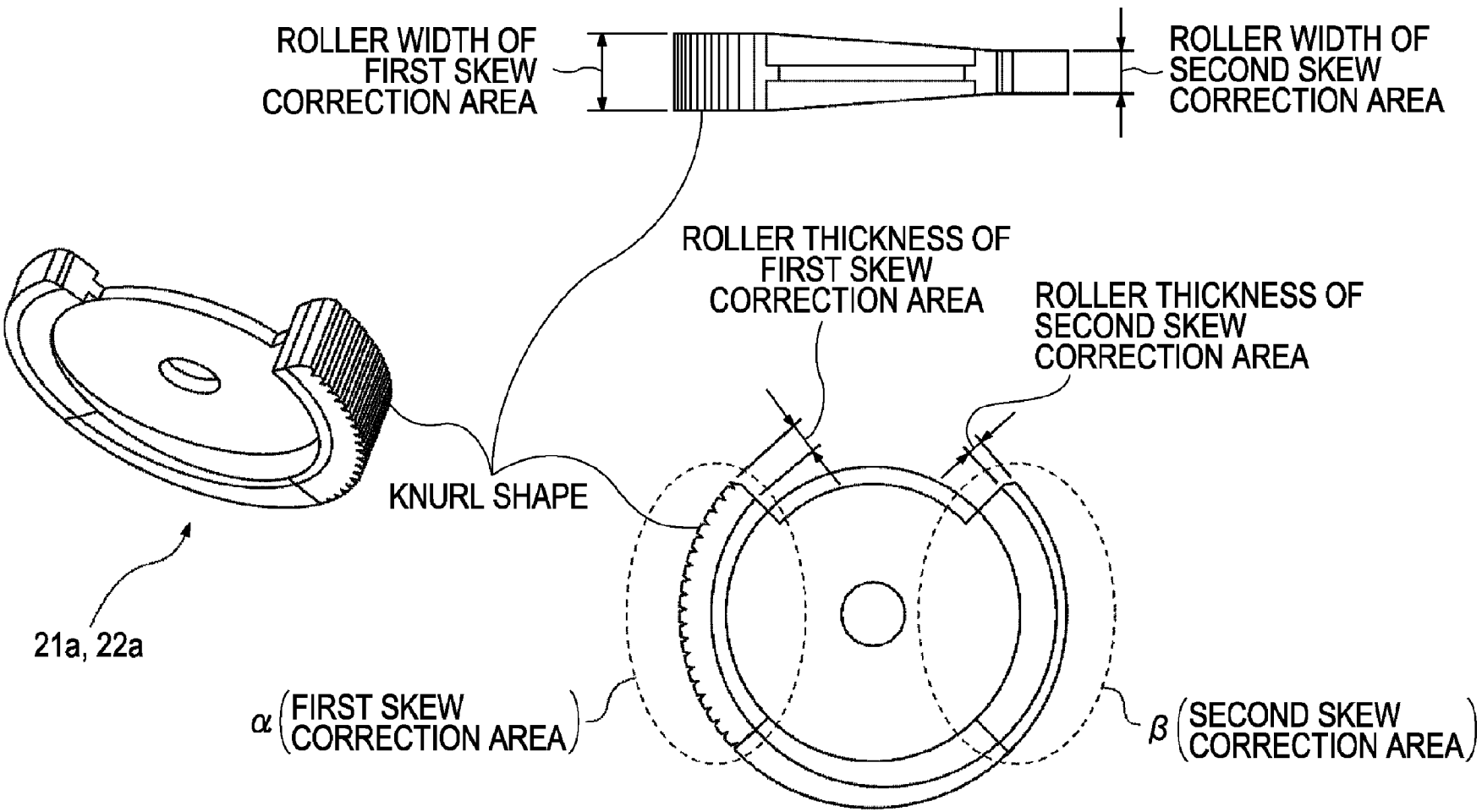
FIG. 14 is an explanatory diagram of an example skew correction roller according to the second embodiment.

FIG. 14 illustrates the skew correction rollers 21*a* and 22*a*, which include a skew correction area α arranged to perform the first roughly skew correction, and a skew correction area β arranged to perform the second high-precision skew correction. The skew correction area α arranged to perform the first skew correction has a configuration wherein the thickness in the radial direction of the roller is thick, and also the width in the shaft direction is great, and the contact area as to the sheet S is greater than the contact area as to the sheet S at a later-described skew correction area β. Further, a knurl glove shape is formed on the roller surface which is strong to slips such as paper powder, and endurance. With the skew correction area β arranged to perform the second skew correction, the thickness in the radial direction of the correction roller and the width in the shaft direction are small, and the roller surface is ground with high precision. Thus, with the skew correction area α, the frictional coefficient is set greatly as compared with the skew correction area β, whereby a sheet can be conveyed with great conveying force.

FIG. 15 illustrates a schematic view of the skew correction arrangement employing the above-mentioned skew correction rollers 21*a* and 22*a*. The skew correction driven rollers 21*b* and 22*b* are pressed by pressing springs 21*c* and 22*c* via a driven roller shaft 20*b*. Also, one ends of the pressing springs 21*c* and 22*c* are attached with pressing arms 21*d* and 22*d*, and the pressing arms 21*d* and 22*d* are connected to pressurization regulating cams 21*e* and 22*e* attached on the motor shafts of the skew correction motors 23 and 24.

The pressurization regulating cams 21*e* and 22*e* are configured to slide the pressing arms 21*d* and 22*d* to change the lengths of the pressing springs 21*c* and 22*c*, thereby changing the pressurization force as to the skew correction rollers 21*a* and 22*a* of the skew correction driven rollers 21*b* and 22*b*. Therefore, with the cam surfaces of the pressurization regulating cams 21*e* and 22*e* slide-contacted to the pressing arms 21*d* and 22*d*, a great radial surface is configured to slide-contact to the pressing arms 21*d* and 22*d* when the first skew correction area α faces the skew correction driven rollers 21*b* and 22*b*. Also, a small radial surface is configured to slide-contact to the pressing arms 21*d* and 22*d* when the second skew correction area β faces the skew correction driven rollers 21*b* and 22*b*.

Also, the first and second skew correction areas α and β are set such that the time when the first skew correction area α slide-contacts the sheet S is shorter than the time when the second skew correction area β slide-contacts the sheet S. With the first skew correction area α, the pressurization force as to the sheet S, and the contact area are greater than those of the second skew correction area α, the sheet can be conveyed with great conveying force in a short period of time. Therefore, with the first skew correction area β, roughly skew correction is performed by rotating the sheet at fast rotation velocity, and with the second skew correction area β, high-precision skew correction is performed by rotating the sheet at slow rotation velocity. At this time, the slipping becomes large in the first skew correction area α, but the slipping is suppressed in the second skew correction area β, and accordingly, skew correction can be completed with high precision in the second skew correction area β.

Figure 15A:
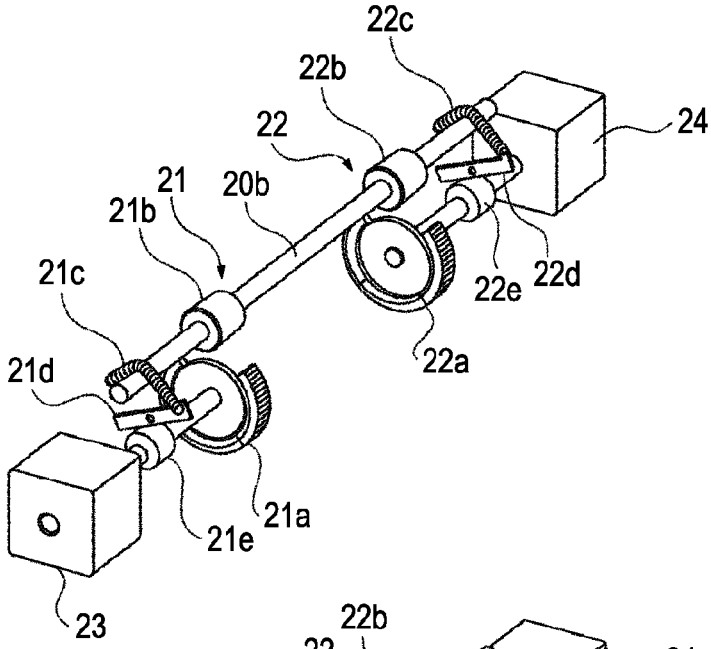
FIG. 15 is an explanatory diagram of an example skew correction configuration according to the second embodiment.
Figure 15B:
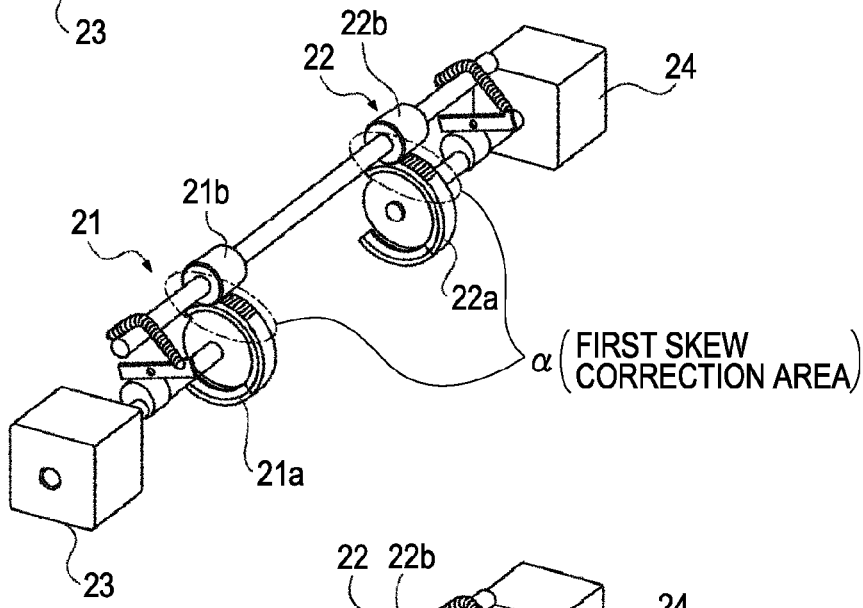
Figure 15C:
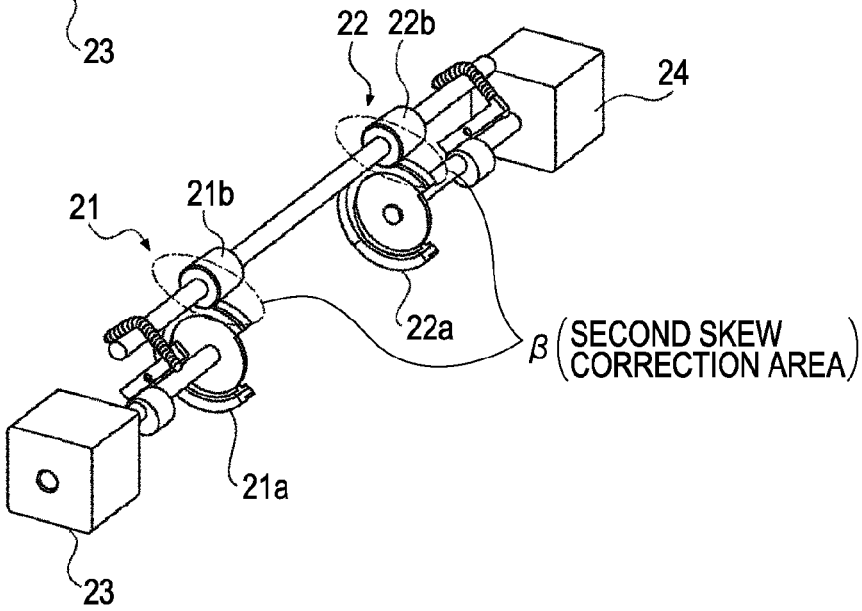

The skew correction driven roller pair 21 and 22 activated by the skew correction motors 23 and 24 make the transition from a state of being stopped shown in FIG. 15A to a state shown in FIG. 15B in which skew correction is performed with the first skew correction area α. At this time, the skew correction driven roller pair 21 and 22 are pressed maximally by the pressurization regulating cams 21*e* and 22*e*. Next, as shown in FIG. 15C, skew correction is performed with the second skew correction area β. At this time, the skew correction driven roller pair 21 and 22 are pressed minimally by the pressurization regulating cams 21*e* and 22*e*.

Figure 16:
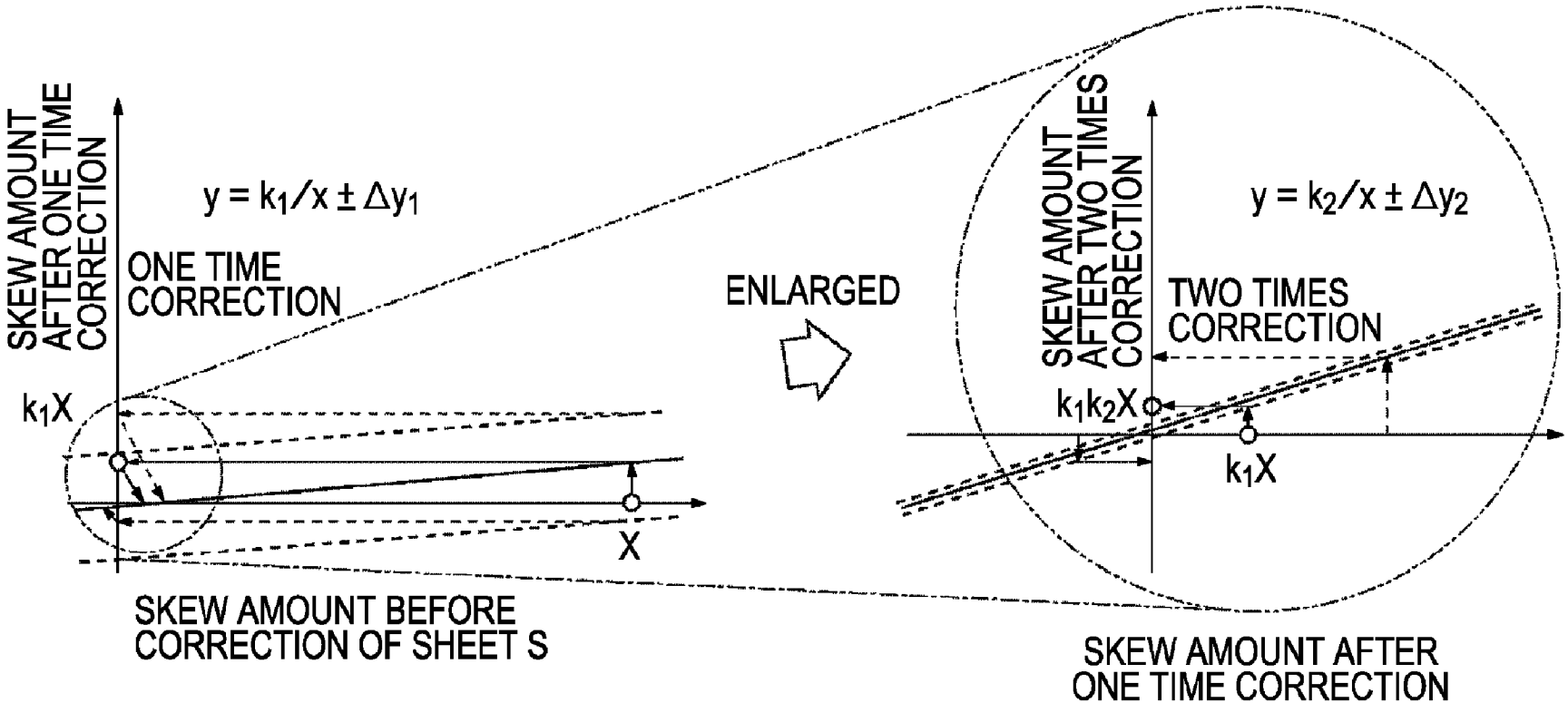
FIG. 16 is an explanatory diagram of an example skew correction accuracy according to skew correction of the second embodiment.
Figure 17:
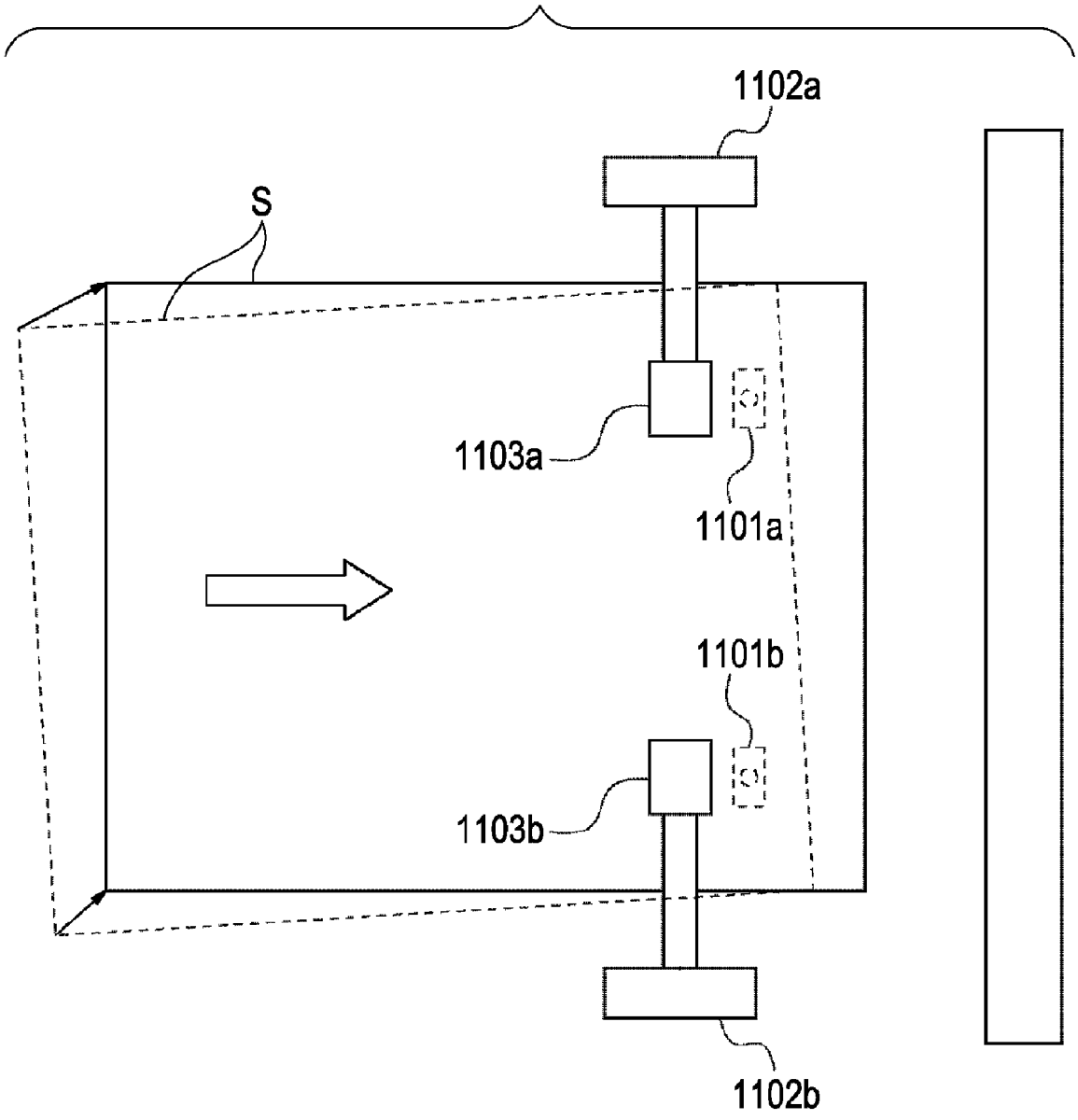
FIG. 17 PRIOR ART
FIG. 17 is a schematic operation diagram according to skew correction of an existing conveying apparatus.
Figure 18A:
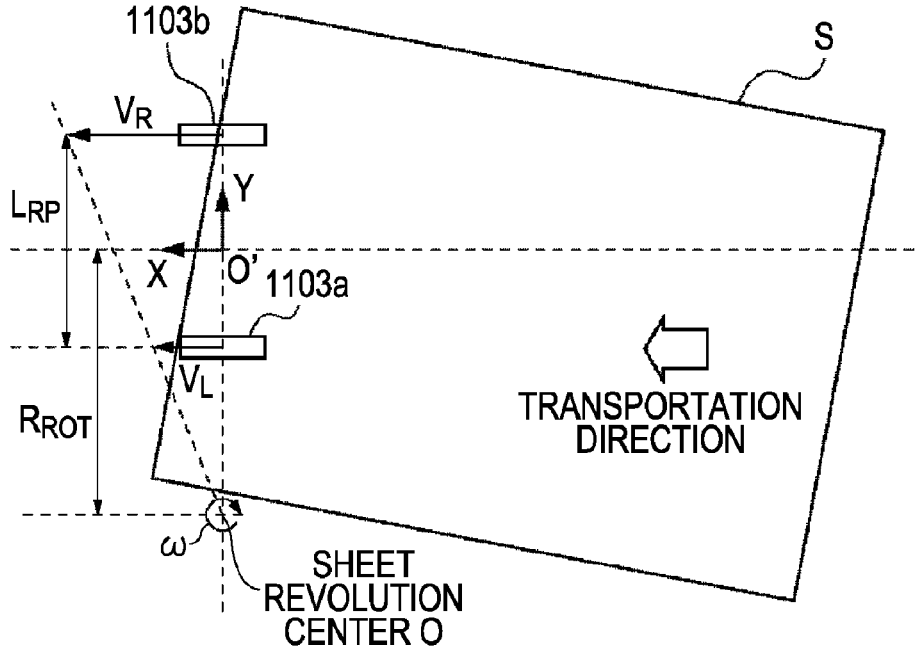
FIG. 18A PRIOR ART
FIG. 18 is an operation parameter explanatory diagram at the upper surface direction according to skew correction of the existing conveying apparatus.
Figure 18B:
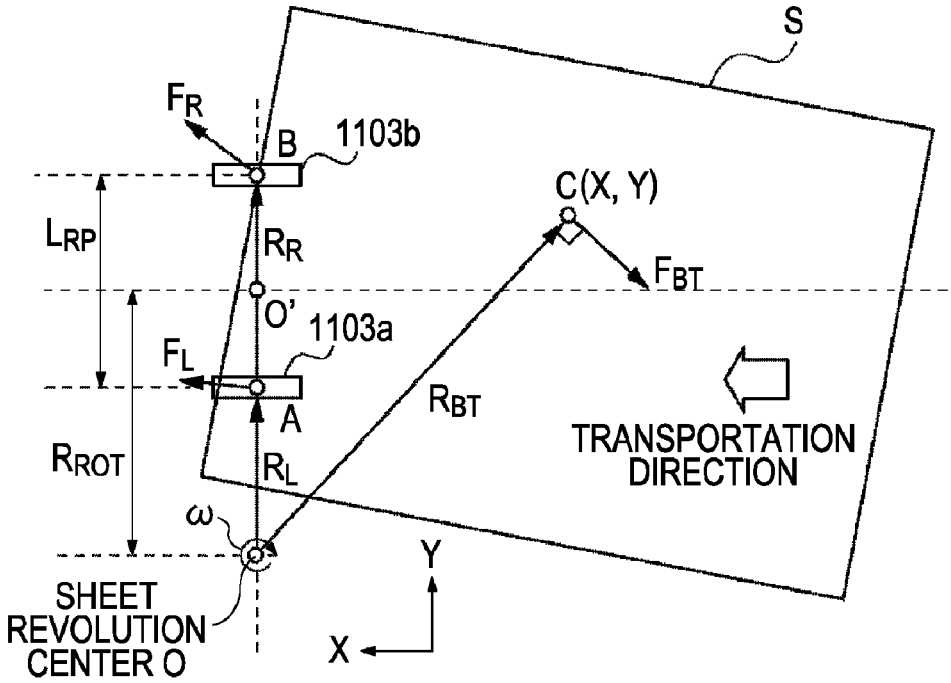
FIG. 18B PRIOR ART
Figure 19:
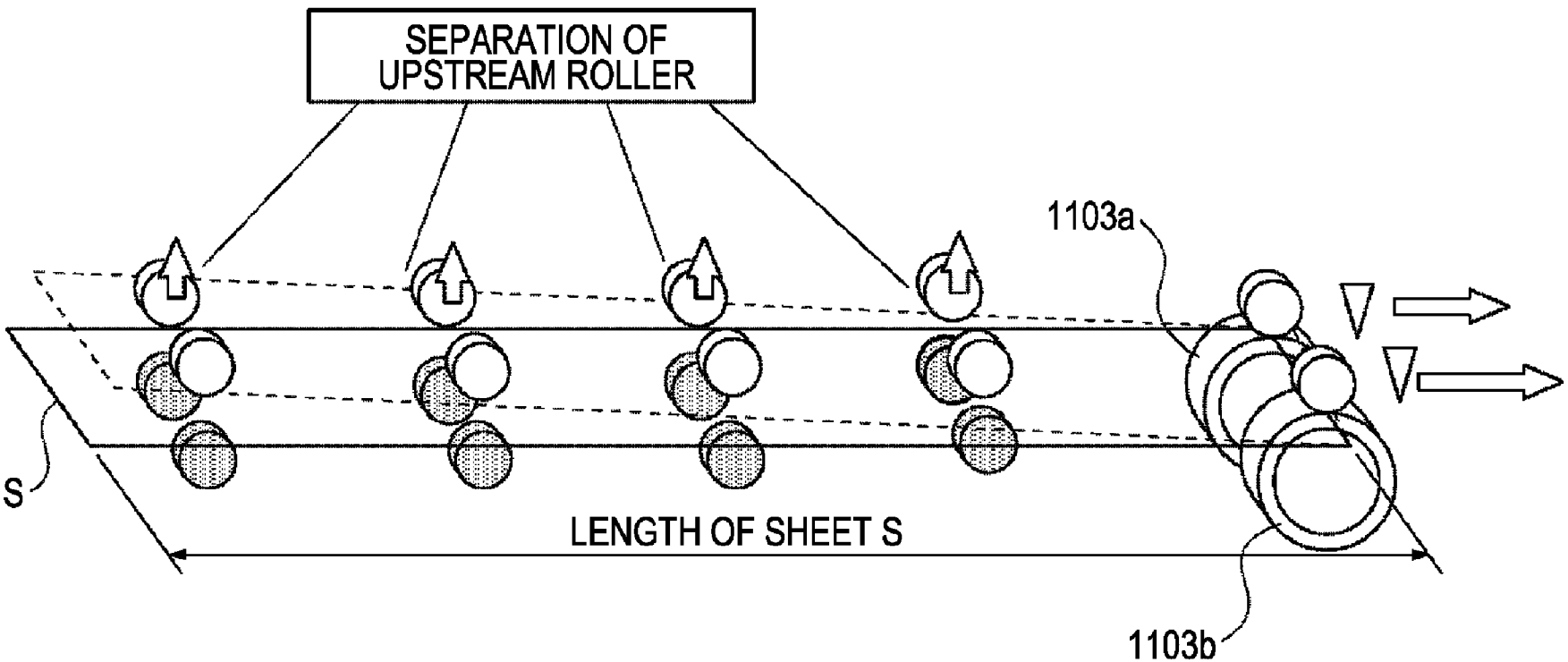
FIG. 19 PRIOR ART
FIG. 19 is a schematic operation diagram according to skew correction of the existing conveying apparatus.

FIG. 16 is a conceptual view of skew correction accuracy at skew correction according to the present second embodiment. With the first skew correction area α, the thickness in the radial direction, width in the shaft direction, and pressurization force of the skew roller are great, and the roller surface has a knurl glove shape, which handles slipping of the sheet S well. Therefore, even skew irregularities can be corrected, such as great skewing wherein the sheet S is greatly skewed, small skewing wherein the sheet S is skewed due to distortion within the sheet S.

Next, with the second skew correction area β, the thickness in the radial direction, width in the shaft direction, and pressurization force of the skew roller are small, and the roller surface is ground with high precision. Therefore, the second skew correction area β is weak as to the slip of the sheet S at the time of great skewing, but when the skew amount of the sheet S is small, the skew correction accuracy due to distortion within the sheet S is hardly influenced by aggravation. Accordingly, the great skewing of the sheet S is roughly corrected with the first skew correction area α, which causes the skew amount of the sheet S to be small, and then the skew having a few irregularities of the sheet S is corrected with the second skew correction area β, whereby skew correction can be performed with high precision.

With the present embodiment, according to the differences of the thickness and surface shape of the roller, a contact state as to the sheet S has been changed between the first skew correction area α and the second skew correction area β, but the same advantage can be obtained even in the event of changing the roller material between the first skew correction area α and the second skew correction area β.

With the above-mentioned first and second embodiments, the first skew correction and the second skew correction have been performed employing the same skew correction roller pair 21 and 22, but the same advantage can be obtained even employing different skew correction roller pairs. Specifically, a skew correction roller pair for the first skew correction and a skew correction roller pair for the second skew correction are provided on positions whose conveying direction or shaft direction differs, and skew correction may be performed sequentially, such as the first, and second. Also, combining the first embodiment and the second embodiment enables skew correction with further high precision.

With the above-described embodiments, an example has been shown wherein the present invention is applied to an image forming apparatus configured to form an image on a sheet, but the present invention can be applied to the document feeder 250 shown in FIG. 1 configured to feed originals to the scanner 2000 serving as an image scanning unit. Specifically, with an image scanning apparatus made up of the scanner 2000, and the document feeder 250, the skew of an original is corrected accurately by the middle of the original being sent to the scanner 2000, whereby image data including no skew of originals can be obtained.

As described above, even in the event that a bent conveying guide is disposed upstream of the registration portion 1, and the great skewing of the sheet S is corrected, which is thick paper having great inertial force or bending rigidity and large in size, correction accuracy can be improved by performing skew correction two times. That is to say, the great skewing of the sheet S is roughly corrected with the first roughly skew correction setting, and the reduced skew of the sheet S can be corrected accurately with the second high-precision skew correction setting. Thus, even in the event of an apparatus being reduced in size, or an apparatus configured to convey various types of sheets, a high-quality image forming apparatus and image scanning apparatus capable of conveying a sheet in a stable manner can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-175565 filed Jun. 26, 2006, which is hereby incorporated by reference herein in its entirety.

What is claimed is:

1. A sheet conveying apparatus comprising:

a skew detection unit configured to detect a skew of a sheet; and a skew correction unit including two sets of roller pairs for conveying the sheet by independently rotating, disposed orthogonal to a sheet conveying direction, configured to convey and rotate the sheet to correct the skew of the sheet by a difference of sheet conveying velocity of the respective roller pairs based on a detection by the skew detection unit, wherein the skew correction unit performs a first skew correction operation and a second skew correction operation after the first skew correction operation, and a difference of the sheet conveying velocity for the second skew correction operation is smaller than a difference of the sheet conveying velocity for the first skew correction operation.

2. A sheet conveying apparatus comprising:

a skew detection unit configured to detect a skew of a sheet; and a skew correction unit including two sets of roller pairs for conveying the sheet by independently rotating, disposed orthogonal to a sheet conveying direction, configured to convey and rotate the sheet to correct the skew of the sheet by a difference of sheet conveying velocity of the respective roller pairs based on a detection by the skew detection unit, wherein the skew correction unit performs a first skew correction operation and a second skew correction operation after the first skew correction operation, and performs the first skew correction operation and the second skew correction operation such that a correction time for the second skew correction operation is longer than a correction time for the first skew correction operation.

3. A sheet conveying apparatus comprising:

a skew detection unit configured to detect a skew of a sheet; and a skew correction unit including two sets of roller pairs for conveying the sheet by independently rotating, disposed orthogonal to a sheet conveying direction, configured to convey and rotate the sheet to correct the skew of the sheet by a difference of sheet conveying velocity of the respective roller pairs based on a detection by the skew detection unit, wherein the skew correction unit performs a first skew correction operation and a second skew correction operation after the first skew correction operation, and a first skew correction area for the first skew correction operation and a second skew correction area for the second skew correction operation are formed on driving rollers of the respective roller pairs, and the first skew correction area is set so as to have a greater contact area as to the sheet, and lower surface accuracy as compared with the second skew correction area.

4. An image forming apparatus comprising:

a sheet conveying apparatus including, a skew detection unit configured to detect a skew of a sheet;

a skew correction unit including two sets of roller pairs for conveying the sheet by independently rotating, disposed orthogonal to a sheet conveying direction, configured to convey and rotate the sheet to correct the skew of the sheet by a difference of sheet conveying velocity of the respective roller pairs based on a detection by the skew detection unit, wherein the skew correction unit performs a first skew correction operation and a second skew correction operation after the first skew correction operation, and a difference of the sheet conveying velocity for the second skew correction operation is smaller than a difference of the sheet conveying velocity for the first skew correction operation; and an image forming portion configured to form an image on a sheet conveyed by the sheet conveying apparatus.

5. An image forming apparatus comprising:

a sheet conveying apparatus including, a skew detection unit configured to detect a skew of a sheet; and a skew correction unit including two sets of roller pairs for conveying the sheet by independently rotating, disposed orthogonal to a sheet conveying direction, configured to convey and rotate the sheet to correct the skew of the sheet by a difference of sheet conveying velocity of the respective roller pairs based on a detection by the skew detection unit, wherein the skew correction unit performs a first skew correction operation and a second skew correction operation after the first skew correction operation, and performs the first skew correction operation and the second skew correction operation such that a correction time for the second skew correction operation is longer than a correction time for the first skew correction operation; and an image forming portion configured to form an image on a sheet conveyed by the sheet conveying apparatus.

6. An image forming apparatus comprising:

a sheet conveying apparatus including, a skew detection unit configured to detect a skew of a sheet; and a skew correction unit including two sets of roller pairs for conveying the sheet by independently rotating, disposed orthogonal to a sheet conveying direction, configured to convey and rotate the sheet to correct the skew of the sheet by a difference of sheet conveying velocity of the respective roller pairs based on a detection by the skew detection unit, wherein the skew correction unit performs a first skew correction operation and a second skew correction operation after the first skew correction operation, and a first skew correction area for the first skew correction operation and a second skew correction area for the second skew correction operation are formed on driving rollers of the respective roller pairs, and the first skew correction area is set so as to have a greater contact area as to the sheet, and lower surface accuracy as compared with the second skew correction area; and an image forming portion configured to form an image on a sheet conveyed by the sheet conveying apparatus.

* * * * *